US011649015B2

(12) United States Patent
Watkins et al.

(10) Patent No.: US 11,649,015 B2
(45) Date of Patent: May 16, 2023

(54) ANCHOR RAIL FOR PERSONAL WATERCRAFT

(71) Applicant: Yamaha Motor Corporation, USA, Cypress, CA (US)

(72) Inventors: Scott Jeffery Watkins, Canton, GA (US); Erik Allen Holmen, Lakewood Ranch, FL (US); Robert Owen Brady, Sarasota, FL (US); Brian Travis Johnson, Canton, GA (US); Louis Robert Doucette, Acworth, GA (US); Michael James Ricciardi, Marietta, GA (US)

(73) Assignee: YAMAHA MOTOR CORPORATION, USA, Cypress, CA (US)

( * ) Notice: Subject to any disclaimer, the term of this patent is extended or adjusted under 35 U.S.C. 154(b) by 0 days.

(21) Appl. No.: 17/929,990

(22) Filed: Sep. 6, 2022

(65) Prior Publication Data

US 2023/0002016 A1 Jan. 5, 2023

Related U.S. Application Data

(63) Continuation of application No. 17/327,408, filed on May 21, 2021.

(Continued)

(51) Int. Cl.

| | |
|---|---|
| ***B63B 34/10*** | (2020.01) |
| ***B63B 34/75*** | (2020.01) |
| ***B63B 27/14*** | (2006.01) |

(52) U.S. Cl.

CPC ..... *B63B 34/10* (2020.02); *B63B 27/146* (2013.01); *B63B 34/75* (2020.02)

(58) Field of Classification Search

CPC ..... B63B 34/00; B63B 34/10; B63B 34/75; B63B 27/00; B63B 27/146; B63B 29/00; B63H 20/00; B63H 20/06

(Continued)

(56) References Cited

U.S. PATENT DOCUMENTS

| | | | |
|---|---|---|---|
| 4,085,473 | A | 4/1978 | Franklin |
| 4,726,317 | A | 2/1988 | Ritten et al. |

(Continued)

FOREIGN PATENT DOCUMENTS

| | | |
|---|---|---|
| AU | 2021203389 | 12/2021 |
| CA | 3 119 808 | 11/2021 |

(Continued)

OTHER PUBLICATIONS

Extended European Search Report for European Application No. 21176550.8, dated Oct. 15, 2021, in 9 pages.

*Primary Examiner* — Lars A Olson

(74) *Attorney, Agent, or Firm* — Knobbe, Martens, Olson & Bear, LLP

(57) ABSTRACT

A personal watercraft with cargo-carrying surface and an anchor rail mounted on a surface of the personal watercraft. The anchor rail being adjacent to the cargo-carrying surface and exposed to an environment. The anchor rail can include an outwardly facing surface exposed to the environment, and the anchor rail is secured to the personal watercraft in such a manner that the outwardly facing surface is recessed relative to the cargo-carrying surface to form a recess or that the outwardly facing surface is flush with the cargo-carrying surface.

30 Claims, 28 Drawing Sheets

Related U.S. Application Data

(60) Provisional application No. 63/032,059, filed on May 29, 2020.

(58) Field of Classification Search
USPC ..... 114/55.57
See application file for complete search history.

(56) References Cited

U.S. PATENT DOCUMENTS

| | | | |
|---|---|---|---|
| 5,429,290 | A | 7/1995 | Greene, Jr. |
| 5,499,595 | A | 3/1996 | Pollen |
| 6,021,734 | A | 2/2000 | Sperberg |
| 6,298,801 | B1 | 10/2001 | May |
| 6,866,001 | B1 | 3/2005 | Cuccia |
| 7,004,091 | B2 | 2/2006 | Adamczyk et al. |
| 7,124,704 | B1 | 10/2006 | Strom |
| 7,188,573 | B2 | 3/2007 | Hirabara |
| 7,341,016 | B2 | 3/2008 | Terleski et al. |
| 7,886,677 | B2 | 2/2011 | Strom |
| 9,016,228 | B2 | 4/2015 | Dorton et al. |
| 9,120,536 | B2 | 9/2015 | Isaac |
| 9,387,910 | B2 | 7/2016 | Isaac |
| 9,517,824 | B1 | 12/2016 | Rondeau et al. |
| 9,789,931 | B2 | 10/2017 | Czipri |
| 10,577,057 | B1 | 3/2020 | Hull |
| 10,597,121 | B2 | 3/2020 | Morgan et al. |
| 11,377,177 | B2 | 7/2022 | Araki et al. |
| 2002/0129757 | A1 | 9/2002 | Matthews |
| 2011/0132252 | A1 | 6/2011 | Kaye |
| 2018/0044985 | A1 | 2/2018 | Orscheln et al. |
| 2022/0106022 | A1 | 4/2022 | Araki et al. |

FOREIGN PATENT DOCUMENTS

| | | |
|---|---|---|
| EP | 3915867 | 12/2021 |
| JP | 2021-191671 | 12/2021 |
| WO | WO 82/01173 | 4/1982 |
| WO | WO 2013/036940 | 3/2013 |

ANCHOR RAIL FOR PERSONAL WATERCRAFT

CROSS-REFERENCE TO RELATED APPLICATIONS

The present application, which is a continuation application of a co-pending U.S. patent application Ser. No. 17/327,408 filed on May 21, 2021 and entitled, "DECK EXTENDER FOR WATERCRAFT", the entirety of which is hereby incorporated herein by reference, and which claims priority under 35 U.S.C. 119(e) of the U.S. provisional patent application, Application No. 63/032,059, filed on May 29, 2020, and entitled "DECK EXTENDER FOR WATERCRAFT", which is also hereby incorporated by reference in its entirety.

BACKGROUND OF THE INVENTIONS

Field of the Inventions

The present inventions relate to personal watercraft, and more specifically, accessories such as deck extenders for personal watercraft.

Description of the Related Art

A conventional personal watercraft accessory platform is described in U.S. Pat. No. 10,577,057. This personal watercraft platform is modular and removable for providing storage and a workspace above the rear deck of a PWC. The modular watercraft platform includes a generally flat upper and lower surface supported by a plurality of vertical struts spacing the lower surface of the platform above the original rear deck of the watercraft.

Another conventional personal watercraft accessory is disclosed in U.S. Pat. No. 9,517,824. This personal watercraft accessory includes a removable rear extension for the aft end of the watercraft which includes a longitudinal channel that receives a portion of the propulsion system and through which a stream of water is directed for purposes of propulsion for the associated watercraft. This deck extension includes numerous surfaces and wall portions meant to conform to portions of the lower hull of the watercraft that sit below the waterline.

SUMMARY OF THE INVENTIONS

An aspect of at least one of the inventions disclosed herein includes the realization that a deck extender for a watercraft can be supported in a cantilevered configuration. Such a deck extender can have an upper support surface that extends beyond an edge of an original watercraft deck with attachment and support surfaces of the deck above the water line providing a substantial portion or all of the structural support for the deck extender. For example, a deck extender for a watercraft can include sleeve members fixed to the upper deck and a deck portion having tabs that extend into the sleeves, wherein the sleeves resist uplift of the tabs. A further outboard portion of the deck extender can contact a portion of the deck of the watercraft so as to provide a support with sufficient strength such that an outboard portion of the deck can extend beyond an edge of the watercraft in a cantilevered fashion. Further, such a configuration lends itself to a low profile configuration, thereby avoiding separate vertical struts for spacing the removable deck away from the upper deck of the watercraft. As such, a deck extender can have a low profile and the cantilevered configuration can effectively extend an upper deck surface of the watercraft for example, but without limitation, four inches or more beyond an edge of the watercraft.

In some embodiments, the upper surface of the deck extender, when installed in use, is generally parallel or substantially parallel to a surface of the water when the watercraft is at rest in a body of water. This can be advantageous because some watercraft include sloped rear deck areas, for example, behind the rearmost seat, that slope gently towards the waterline and rearwardly away from the rear seat. This configuration is common and more optimized for watersports and weight reduction of the watercraft. However, some users prefer to have additional, relatively level and flat space at the rear of a watercraft for facilitating other activities according to their preference. Thus, providing an extended flat surface, generally parallel to the waterline of the watercraft, can provide further conveniences for some users.

Thus, in some embodiments, a deck extender for a watercraft can comprise a deck member comprising an upper support surface, a lower surface, and first and second mounting tabs configured with sufficient strength to support the deck member in a cantilevered configuration on a rear portion of an upper deck of a personal watercraft.

DETAILED DESCRIPTION OF THE PREFERRED EMBODIMENT

The inventions disclosed herein are described below in the context of accessories for personal watercraft because the inventions disclosed herein have particular utility in this context. However, the inventions disclosed herein are applicable to other contexts as well. Further, the personal watercraft described below are illustrated in several different orientations including a static orientation, in which the watercraft floats in still water in a displacement mode of buoyancy, a transition orientation in which the watercraft, during acceleration, moves from a displacement mode of buoyancy to a planing mode, and a planing orientation in which a watercraft is moving at a speed sufficient to support the watercraft on the surface of the water with a minimal amount of the hull being wetted and in contact with the water.

Figure 1A:
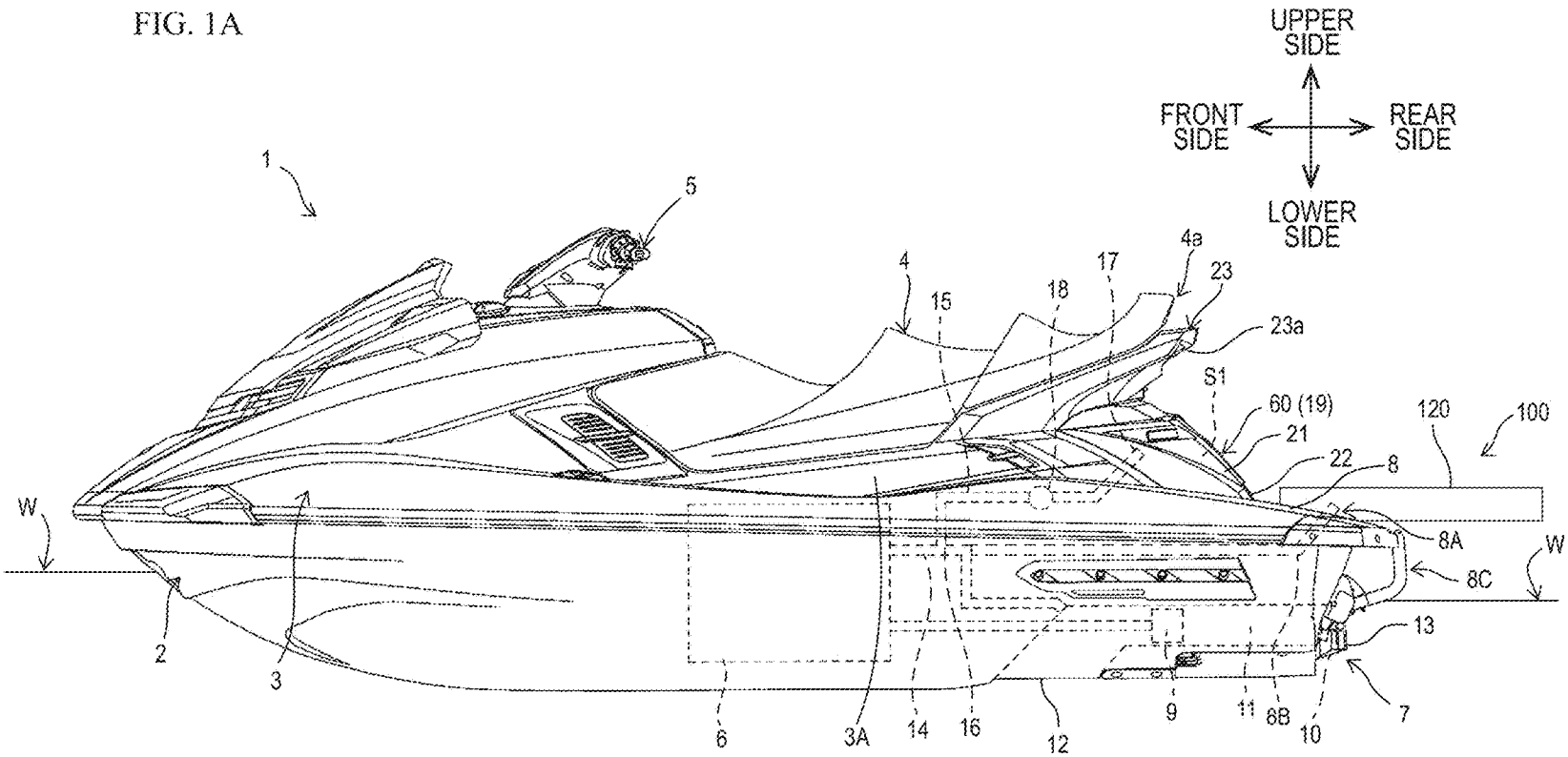
FIG. 1A is a side elevational view of a personal watercraft at rest in a body of water and including a deck extender according to an embodiment.
Figure 1B:
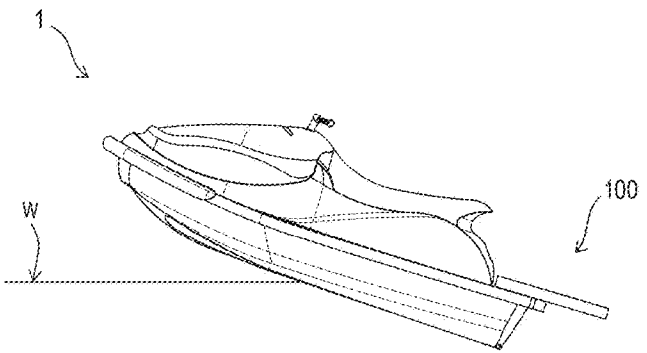
FIG. 1B is a schematic illustration of the personal watercraft having the deck extender and operating in a transition mode.
Figure 1C:
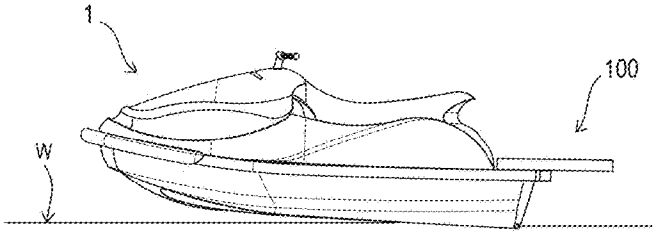
FIG. 1C is a schematic illustration of the personal watercraft with the deck extender operating in a planing condition.
Figure 2:
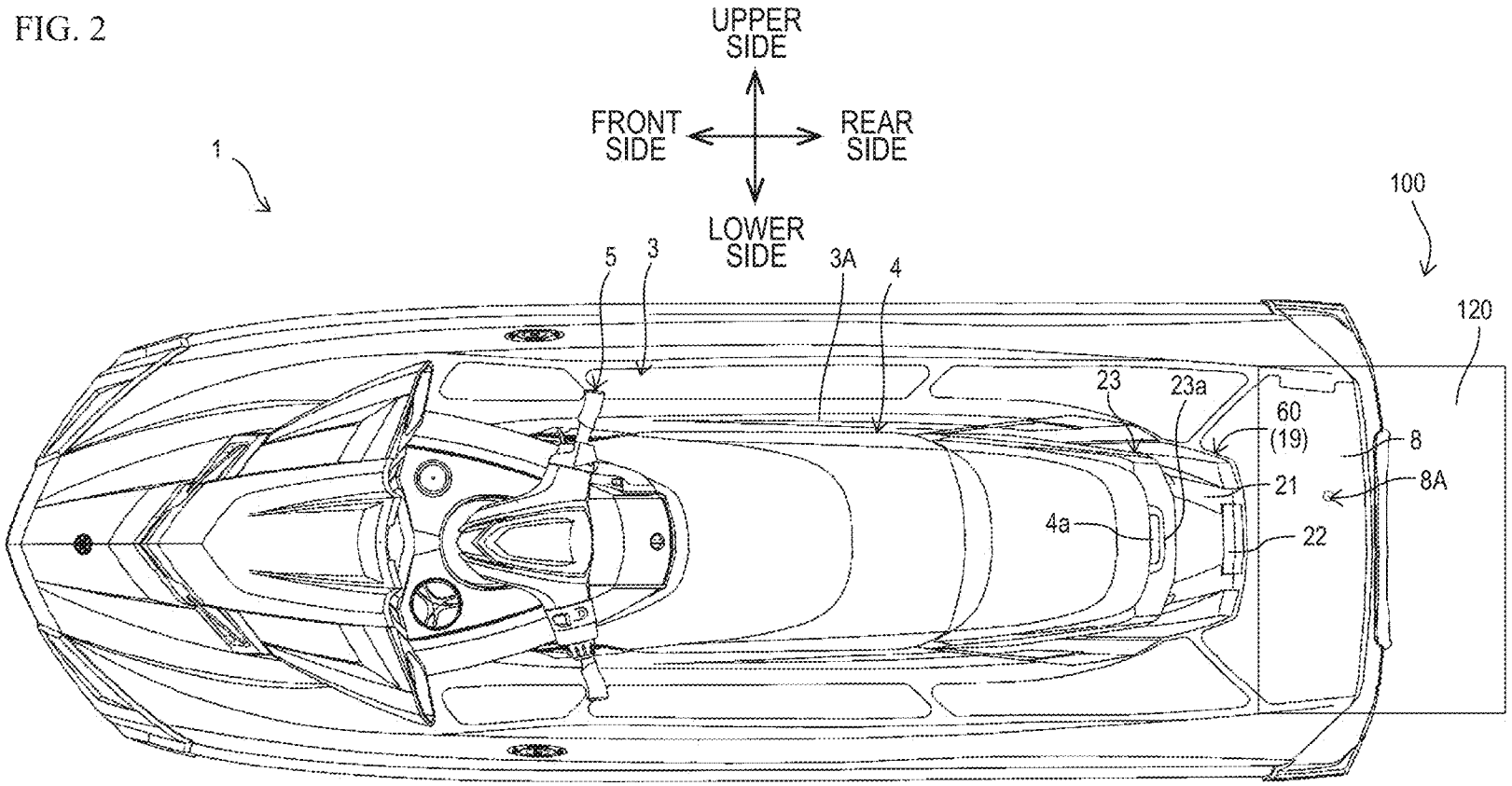
FIG. 2 is a top plan view of the personal watercraft having the deck extender.
Figure 3:
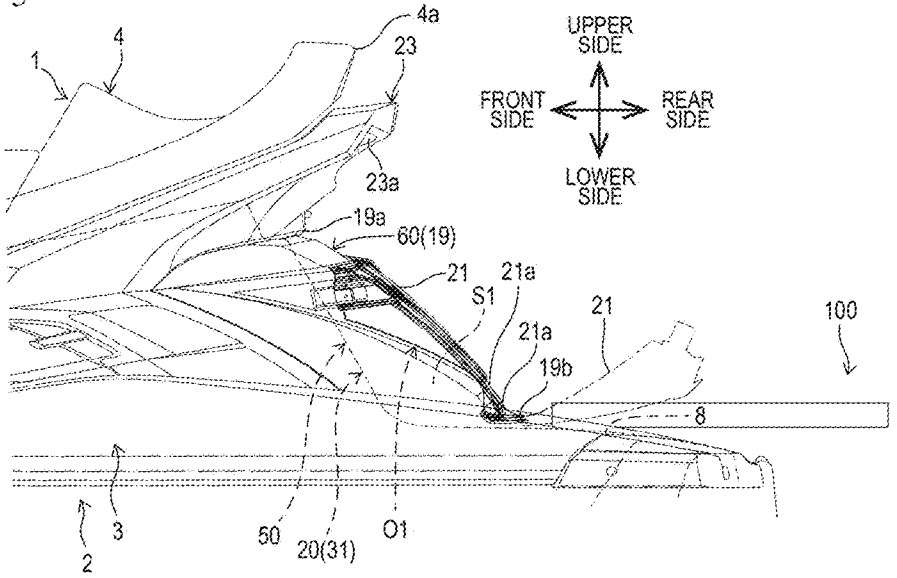
FIG. 3 is an enlarged side elevational view of a rear portion of the personal watercraft having the deck extender and illustrating a movement of a lid of a storage bin.
Figure 4:
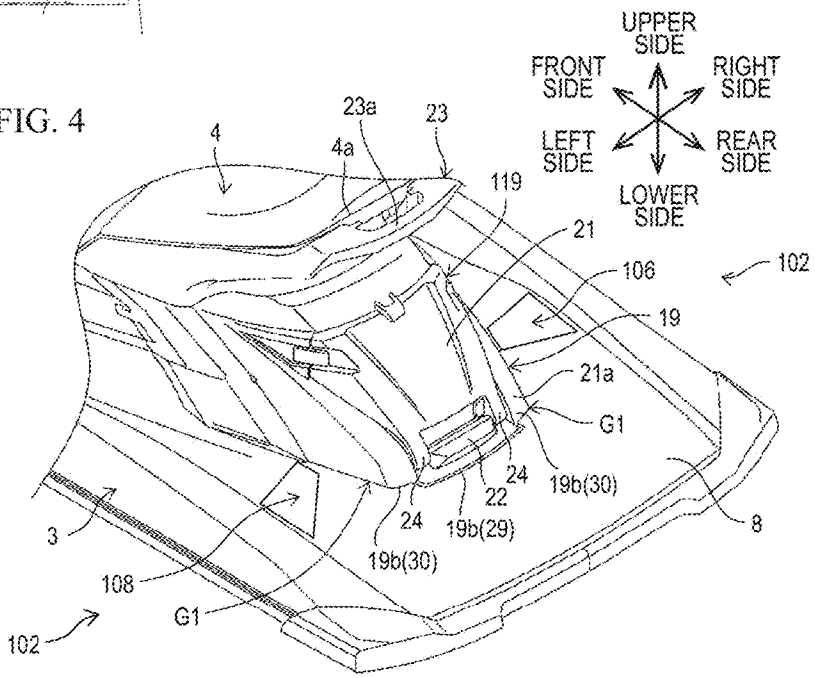
FIG. 4 is an enlarged perspective view of the rear of the personal watercraft having mounting members installed and with the deck extender removed.

FIG. 1A is a side view of a personal watercraft 1 with a deck extender 100 according to an embodiment wherein the personal watercraft 1 is at rest floating in a body of water, FIG. 1B illustrating the personal watercraft 1 being in a state of transition between displacement mode and planing, and FIG. 1C illustrating the personal watercraft 1 in a planing mode. FIG. 2 is a plan view of the personal watercraft 1 including the deck extender 100. FIG. 3 is an enlarged side elevational view of a rear portion of the personal watercraft 1 with the deck extender 100 and illustrating a movement of a lid over a rear storage portion on the personal watercraft 1.

As shown in FIG. 1, the personal watercraft 1 includes a hull 2, a deck 3, a seat 4, and a steering handle 5. The deck 3, which can be referred to as an upper deck, can be attached to the hull along a bond flange. The deck 3 can include a seat pedestal 3A. The seat 4 and the steering handle 5 are disposed above the deck 3. The seat 4 and the steering handle 5 are supported on the deck 3. As shown in FIG. 2, the seat 4 and the steering handle 5 are disposed at a central portion of the personal watercraft 1 in the right-left direction. The seat 4 is disposed at the rear of the steering handle 5 and is supported by the seat pedestal 3A. The seat 4 extends in the front-rear direction in a plan view. The seat 4 has, for example, a three-seater configuration. The seat 4 is not limited to a three-seater configuration, and may have a two-seater configuration or a single-seater configuration.

As shown in FIG. 1, the personal watercraft 1 further includes an engine 6 and a jet pump 7. The engine 6 is disposed inside the hull 2. The jet pump 7 is disposed at the rear portion of the hull 2. The engine 6 is disposed forward relative to the jet pump 7. The seat 4 is disposed above the engine 6. The deck 3 includes a platform 8 disposed at the stern of the personal watercraft 1. The platform 8 slopes gently downwardly, away from the seat 4 and toward the waterline. The jet pump 7 is disposed below the platform 8. The jet pump 7 is driven by the engine 6.

With continued reference to FIG. 1, the personal watercraft 1 is illustrated in a stationary state floating in water, and due to its buoyancy, to a depth shown relative to the waterline. The depth at which the personal watercraft 1 reaches beneath the waterline depends on the total weight and the volume of water displaced by the hull of the personal watercraft 1. As noted above, the platform 8 which forms a rear deck of the personal watercraft 1, slopes gently away from the seat 4 and toward the waterline W. In accordance with some embodiments, the deck extender 100 can be configured such that its upper surface 120 extends generally parallel to the waterline when the personal watercraft 1 is at rest and floating in water. In some embodiments, the upper support surface 120 of the deck extender 100 is not perfectly parallel with the waterline, however, may be closer to parallel with the waterline than the surface of the platform 8.

With reference to FIG. 1B, when the personal watercraft 1 is accelerated from stationary or slow movement within water, towards a planing state, the personal watercraft 1 moves through a transition orientation in which the front end of the personal watercraft rises out of the water. In some embodiments, the deck extender 100 can be configured such that it does not make contact with a surface of the water when the personal watercraft 1 is in transition.

After further acceleration, the personal watercraft 1 will reach a planing state, such as that illustrated in FIG. 1C. For a watercraft such as the personal watercraft illustrated in FIG. 1, a planing state may be reached at speeds above 15-20 miles per hour. In a planing state, as illustrated in FIG. 1C, a much smaller area of the bottom surface of the hull 2 remains in contact with the water thus and as such, a smaller amount of the hull 2 is wetted during forward movement, thereby significantly reducing the hydrodynamic drag between the hull 2 and the water.

As shown in FIG. 3, while a small portion of the platform 8 can be substantially the horizontal below the rear end 4A of the seat 4, the rearward-most portion of a platform 8 slopes gently downwardly towards the waterline W. As shown in FIG. 2, the platform 8 preferably has a quadrilateral shape in a plan view. The right and left sides and the rear side of the platform 8 are open. In a state in which the personal watercraft 1 floats in water, the platform 8 is higher than the waterline W. Therefore, when the deck extender 100 is removed, a passenger can climb down into water from a position on the platform 8 through the lateral side or rear side of the platform 8. Further, a passenger can move from a position in water onto the platform 8 through the lateral side or rear side of the platform 8.

The jet pump 7 is arranged to generate a propulsive force by jetting water suctioned from below, rearwardly. In detail, as shown in FIG. 1, the jet pump 7 includes an impeller 9 joined to the engine 6 and a steering nozzle 10 disposed at the rear of the impeller 9. The impeller 9 is disposed in a flow passage 11 provided inside the personal watercraft 1. A first end portion of the flow passage 11 defines an intake 12 open at the bottom surface of the hull 2, and a second end portion of the flow passage 11 defines an outlet 13 opened at the steering nozzle 10. The steering nozzle 10 is arranged to turn to the right or left according to an operation of the steering handle 5.

When the impeller 9 is driven to rotate by the engine 6, water is suctioned from the intake 12 into the flow passage 11. A such, the portion of the flow passage 11 downstream from the impeller 9 can be considered as the high-pressure side of the jet pump 7. Water suctioned from the intake 12, pumped into the flow passage 11 by the impeller 9, and is then jetted from the outlet through the steering nozzle 10. Accordingly, a propulsive force is generated to propel the personal watercraft 1. When the steering handle 5 is operated, the direction of the steering nozzle 10 changes, and the jetting direction of water from the steering nozzle 10 changes. Therefore, the steering handle 5 is arranged to change the jetting direction of water from the jet pump 7. The personal watercraft 1 is steered by operation of the steering handle 5.

As shown in FIG. 1, the personal watercraft 1 further includes a cooling water passage 14 and a washing water passage 15 disposed inside the personal watercraft 1. The cooling water passage 14 connects the engine 6 with the high pressure side of the jet pump 7. A portion of water pumped into the flow passage 11 by the jet pump 7 is supplied into the cooling water passage 14. Water supplied into the cooling water passage 14 is thereby supplied to a water jacket provided in the engine 6. Accordingly, the engine 6 is cooled.

As shown in FIG. 3, the deck 3 includes a seat support portion 50 which supports the seat 4, and a cover 60 covering the seat support portion 50 at a height between the rear end 4*a* of the seat 4 and the platform 8 from the rear side. The cover 60 includes an outer wall 19, and the seat support portion 50 includes an inner wall 20. The platform 8 and the inner wall 20 preferably are integral with each other, and the outer wall 19 is separate from the platform 8 and the inner wall 20.

The washing water passage 15 includes a first end portion 16 connected to the cooling water passage 14, a second end portion 17 connected to an article storage space S1, described in greater detail below. A check valve 18 is arranged such that water flows in only a direction from the second end portion 17 to the first end portion 16. Therefore, even if water flows into the washing water passage 15 from the cooling water passage 14, this water is checked by the check valve 18. On the other hand, water supplied into the washing water passage 15 from the second end portion 17 flows into the cooling water passage 14 through the check valve 18. The cooling water passage 14 and the water jacket can be washed with water supplied from the washing water passage 15.

Optionally, the personal watercraft 1 can include a visibility nozzle 8A disposed on the platform 8. A passage 8B can connect the nozzle 8A with the high-pressure side of the jet pump 7. The passage 8B can feed water from the high-pressure side of the jet pump 7 to the nozzle 8A which can eject water upwardly into the air during use.

As shown in FIG. 1A, the article storage space S1 is disposed rearward relative to the engine 6. The article storage space S1 is disposed at a height between the rear end 4*a* of the seat 4 and the platform 8. The article storage space S1 is disposed forward relative to the rear end of the platform 8. As shown in FIG. 3, the outer wall 19 defines an opening O1 accessible to the article storage space S1. The opening O1 penetrates through the outer wall 19 in the front-rear direction. The opening O1 is disposed at the rear of the article storage space S1. The article storage space S1 is accessible from the rear side through the opening O1.

As shown in FIG. 3, the outer wall 19 includes a lid 21 arranged to open and close the opening O1. The deck 3 further includes a hinge 22 which joins the lid 21 and the deck 3. The hinge 22 is provided on the lower portion 21*a* of the lid 21. The lid 21 is rotatable around the hinge 22 between a closed position at which the lid 21 closes the opening O1 and an opened position at which the lid 21 opens the opening O1. The hinge 22 is arranged to function as a grip.

As shown in FIG. 2, the personal watercraft 1 further includes a mount grip 23 having a U shape in a plan view disposed along the rear portion of the seat 4. The mount grip 23 extends forward along the rear portion of the seat 4 from the rear end 4*a* of the seat 4. The mount grip 23 includes a grip portion 23*a* provided at the rear end portion of the mount grip 23. As shown in FIG. 1, the hinge 22 is disposed rearward relative to the grip portion 23*a* and lower than the grip portion 23*a*. Further, the hinge 22 is disposed lower than the seat 4. The hinge 22 is closer to the platform 8 than the grip portion 23*a*.

By opening the lid 21, the passenger can take articles out of and put articles into the article storage space S1 through the opening O1 while remaining on the platform 8 or the deck extender 100. Further, the opening O1 is disposed near the rear end 4*a* of the seat 4, so that the passenger can take articles out of and put articles into the article storage space S1 through the opening O1 while sitting on the seat 4. Further, the outer wall 19 is inclined such that the upper end 19*a* of the outer wall 19 is positioned forward relative to the lower end 19*b* of the outer wall 19, so that the passenger sitting on the seat 4 easily accesses the article storage space S1 as compared with, for example, a case where the outer wall 19 extends vertically. Therefore, the passenger can easily access the article storage space S1 from a position on either the deck 3 or the seat 4.

Additionally, in some embodiments, the deck extender 100 can include a generally U-shaped removable deck member that includes a bite portion that provides clearance around the lower end of the lid 21 and thus allows the lid 21 to be moved easily between the closed and open states illustrated in FIG. 3.

With reference to FIGS. 4-8, the deck extender 100 can include a mounting portion 102 and a deck member 104. The mounting portion 102 can include one or more mounting sleeve portions 106. In the illustrated embodiment, the mounting portion 102 includes a right-side mounting sleeve 106 and a left-side mounting sleeve 108.

The mounting sleeves 106 and 108 can be generally channel-shaped, in cross-section. The mounting sleeve 106, and 108 are configured to be mounted at a forward portion of the platform 8 on either side of the seat pedestal 3A. In some embodiments, the mounting sleeve portions 106, 108 are configured to be mounted just rearward from an apex of the deck 3 that forms the foot wells of the watercraft 1, which reaches a maximum depth portion along lateral sides of the seat pedestal 3A, and reaches an apex just forward of the illustrated position of the mounting sleeve portions 106, 108. The surface on either side of the seat pedestal 3*a* extends rearward from the apex and into the platform 8 which may extend generally horizontally in an area just rearward from the seat pedestal, and then gently slopes towards the waterline.

Positioned as such, the mounting sleeve 106, 108 form a generally low profile superstructure of the deck and thus do not present an excessive obstruction of access to the foot wells. For example, water can enter the foot wells during use of the personal watercraft 1. When a watercraft accelerates through a transition speed (FIG. 1B), water in the foot wells can drain rearwardly flowing over the apex of the deck 3 at the rear of the foot wells. Because the mounting sleeve 106, 108 are generally low profile, they do not substantially obstruct all of the water from draining from the foot wells during transition speed operation.

Figure 6:
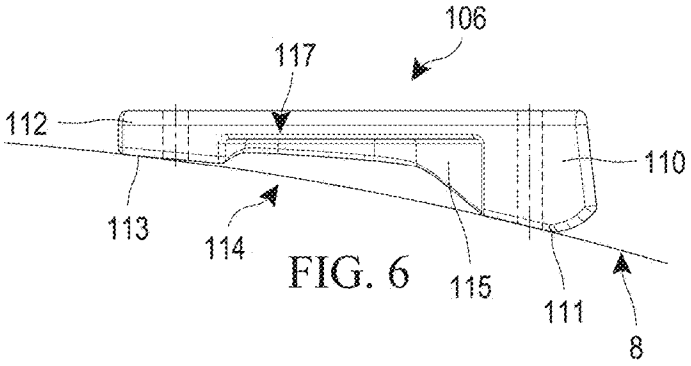
FIG. 6 is a rear elevational view of a mounting sleeve of FIG. 5.
Figure 7:
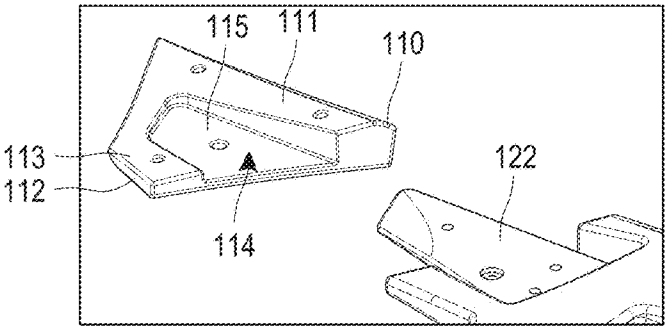
FIG. 7 is a rear, bottom, and right-side perspective, exploded view of a mounting sleeve and a mounting tab of the deck extender.

With continued reference to FIGS. 6-8, the mounting sleeve portions 106, 108 include first and second lateral rail portions 110, 112 and a central channel 114. An upper connecting wall 116 connects the lateral rail portions 110, 112 and extends over the channel 114. The upper connecting wall 116 has an inwardly-facing surface 115, that can serve as a support surface for supporting the deck 104 in a cantilevered manner by contacting portions of the deck 104.

The lateral rail portions 110, 112 can include apertures for receiving fasteners for securing the rails 110, 112 to the platform 8. For example, threaded fasteners such as lag screws, optionally with tapered heads, can be inserted through the lateral rail portions 110, 112 and into the platform 8. Additionally, the rails 110, 112 can include counter-sunk upper orifices for receiving the tapered head, threaded fasteners. The threaded fasteners can extend into and/or through the platform 8 to secure the sleeves 106, 108 to the platform 8. Optionally, the fasteners used to secure the mounting sleeves 106, 108 can be further secured with an adhesive to enhance a watertight seal with the platform 8. With the mounting sleeves 106, 108 attached to the platform, their respective channels 114 face downwardly, i.e., toward the deck.

With continued reference to FIGS. 6-8, with the sleeves 106, 108 mounted to the deck 8, the channel 114 is configured to receive a portion of the removable deck member 104 and for resistance against uplift forces of the received portion. Additionally, in this orientation, the support surface 115 is spaced away from the deck 8 and also faces downwardly toward the deck 8, and thus can resist support the deck 104 in a cantilevered orientation.

Figure 5:
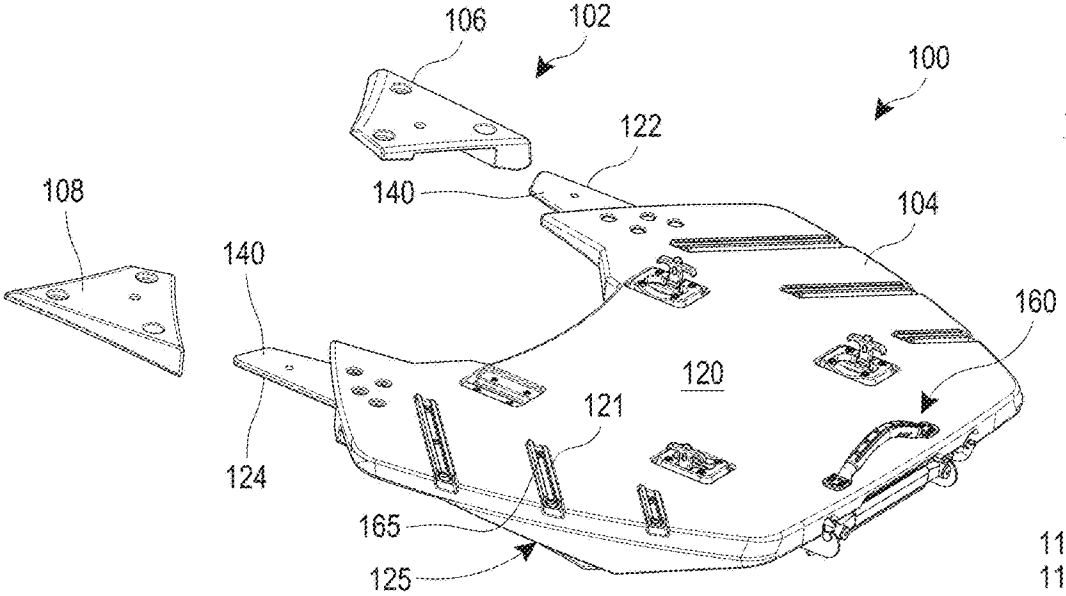
FIG. 5 is a rear perspective and partially exploded view of the deck extender, illustrating mounting tabs separated from mounting sleeves of the deck extender assembly.

For example, with reference to FIG. 5, the removable deck member 104 can include at least one tab member 122. In the illustrated embodiment, the removable deck member 104 includes a right-side tab member 122 and a left-side tab member 124. The right and left tab members 122, 124 are configured to be received into the channels 114 of the mounting sleeve portions 106, 108 respectively.

Figure 8B:
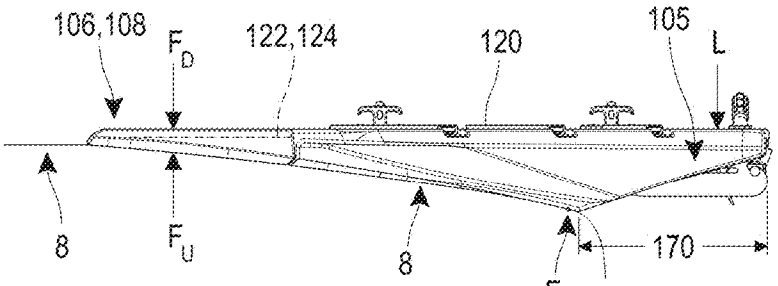
FIG. 8B is a side elevational view of the mounting sleeve and deck extender moved together in an assembled state.
Figure 8A:
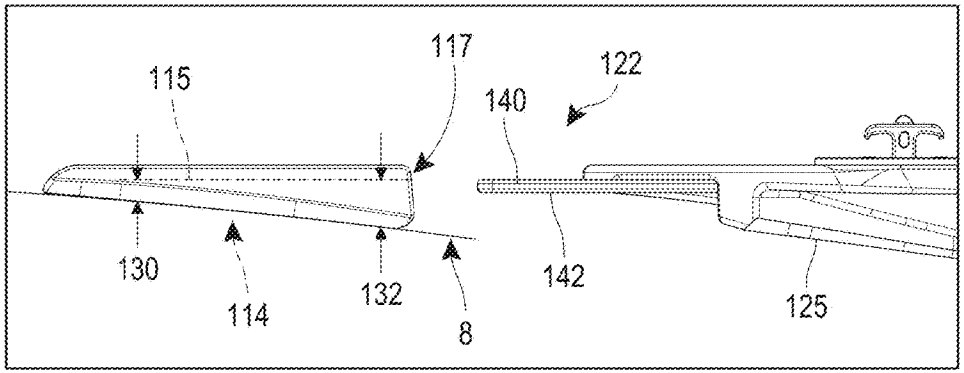
FIG. 8A is an enlarged, exploded, side elevational view of a mounting sleeve and mounting tab.

For example, with reference to FIGS. 6 and 8A, with the sleeves 106, 108 mounted to the deck 8, the channels 114 form rearwardly facing apertures 117, into which the tabs 122, 124 can be inserted.

With reference to FIG. 8A, the channel 114 of the mounting sleeve portions 106, 108 can have a variable depth. For example, a forward portion of the channel 114 can have a first depth 130 and a rearward portion of the mounting sleeve portions 106, 108 can have a second depth 132 that is larger than the first depth 130. In some configurations, this varying depth can be provided by forming the upper wall 116 with a generally uniform thickness with the rails 110, 112 having a varying height being shorter towards the front portion and the first depth 130 and the rearward portions being taller forming the second depth 132 at the rearward portion of the mounting sleeve portions 106, 108. Further, in some embodiments, the bottom surfaces 111, 113 of the rails 110, 112 can be slanted or curved to match a curvature of the corresponding portions of the platform 8.

With continued reference to FIG. 8, the tabs 122, 124 can be configured to extend into the channels 114 of the respective mounting sleeves 106, 108. In some embodiments, the tabs 122, 124 include an upper surface 140 configured to rest against the inwardly facing surface 115 of the channel 114.

With the Optionally, a lower surface 142 of the tabs 122, 124 can be spaced away from the platform 8 or curved or shaped to complement and rest against the upper surface of the platform 8. For example, the lower surface 142 of the tabs 122, 124, can include a flat and/or generally curving configuration to conform with the upper surface of the platform 8 in the vicinity of the mounting sleeve portions 106, 108. Depending on the watercraft, that portion of the platform 8 can be flat, horizontal, or gently curving. Other shapes can also be used.

With reference to FIGS. 9A-12, the deck member 104 can have a generally rectilinear shape with a U-shaped portion 150. The U-shaped portion 150 can comprise a right-side arm portion 152, a left-side arm portion 154 and a bite portion 156 connecting the right and left arm portions 152, 154. The bite portion 156 can include a recess 157 configured to allow the deck member 104 to straddle a rear part of the seat pedestal 3A when the tabs 122, 124 are received within the mounting sleeve portions 106, 108, respectively. Additionally, the bite portion 156 can include a further recess 157 shaped to allow the lid 21 to be moved from the closed position to the open position (FIG. 3).

In some embodiments, the deck member 104 can include an aperture at a rearward edge thereof, which can form a handle. In other embodiments, the rear portion of the removable deck member 104 can be solid with a separate handle 160 attached to an upper surface. Other variations of handle configurations can also be used. In use, any such handle be used by a user when reboarding the deck member 104 from the water and also can be used when carrying the deck member 104 during installation or removal.

The upper surface 120 of the deck member 104 can be generally flat. Additionally, the removable deck member 104 can be configured such that when the tabs 122, 124 are received within the mounting sleeve portions 106, 108, the upper surface 120 is generally horizontal when the personal watercraft 1 is at rest, floating in a body of water. As such, the upper surface 120 can be considered as being generally parallel to a waterline of the personal watercraft 1.

Further, in some embodiments, the personal watercraft 1 to which the removable deck member 104 is attached includes a gently curving platform 8, which can be convex and curve gently downwardly toward the waterline and away from the seat pedestal 3A. Thus, in some embodiments, the lower surface 125 of the deck member 104 can include a gently curved lower surface portion, for example concave when viewed in a side elevational view, and can be configured to rest against the gently curved convex upper surface of the platform 8.

In some embodiments, the lower surface 125 can be segmented with grooves, partitions, and discontinuities such that not the entire lower portion of the deck member 104 rests against the upper surface of the platform 8. Rather, the gaps, recesses, and discontinuities leave a substantial amount of the surface 125 in contact between the lower surface 125 and the platform 8 so as to reduce stress concentrations that would be caused by the use of a plurality of individual struts extending between a platform 8 and the member 104.

For example, the lower surface 125 can be configured to generate contact patches having an approximate total surface area of 20% or more of the footprint area of the lower surface 125 over the platform 8. Such contact patches can help spread the load supported by the deck member 104.

Figure 11:
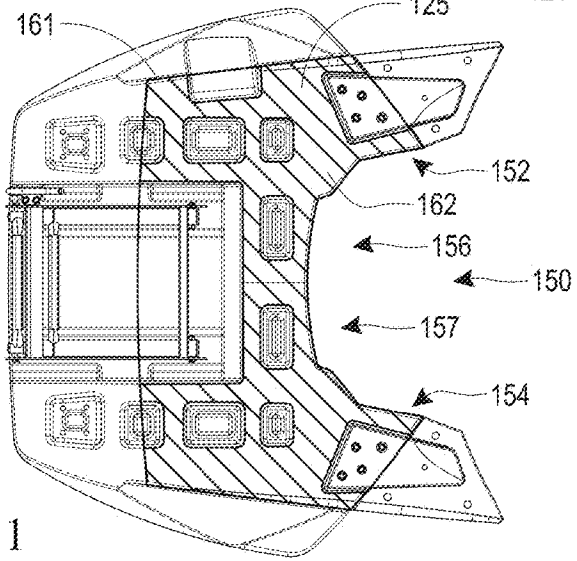
FIG. 11 is a bottom plan view of the deck extender and sleeves of FIG. 9.
Figure 13:
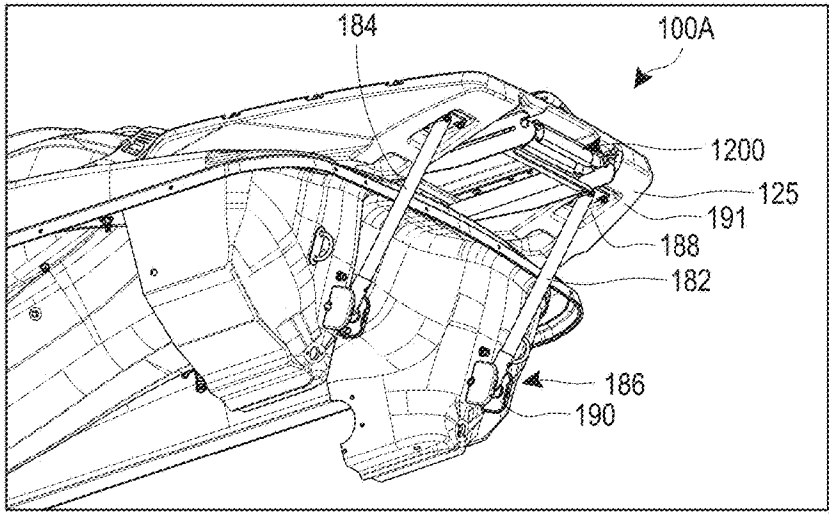
FIG. 13 is a bottom, rear, and left-side perspective view of a modification of the embodiment of the deck extender with optional mounting hardware.
Figure 14:
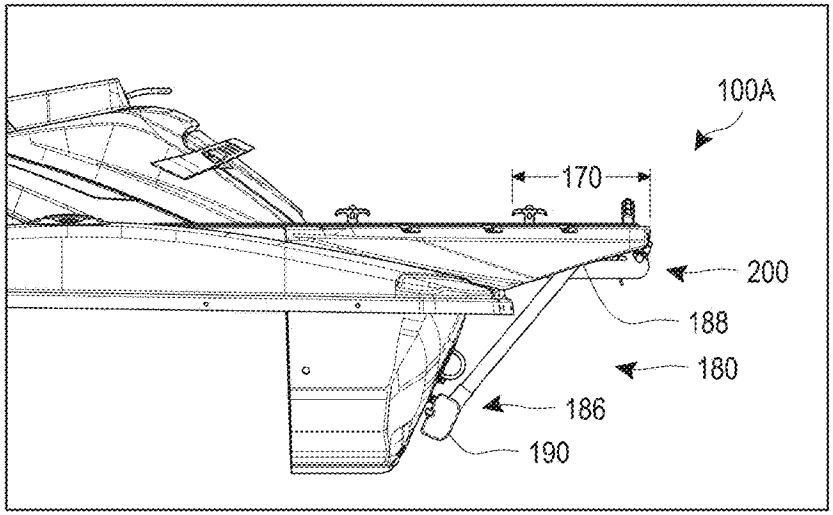
FIG. 14 is a left-side elevational view of the deck extender of FIG. 13.
Figure 15:
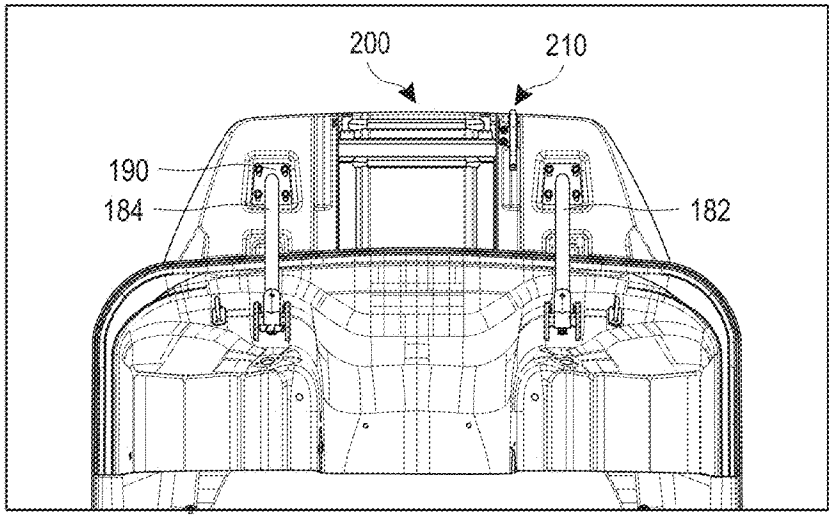
FIG. 15 is an enlarged bottom plan view of the deck extender of FIG. 13.
Figure 16:
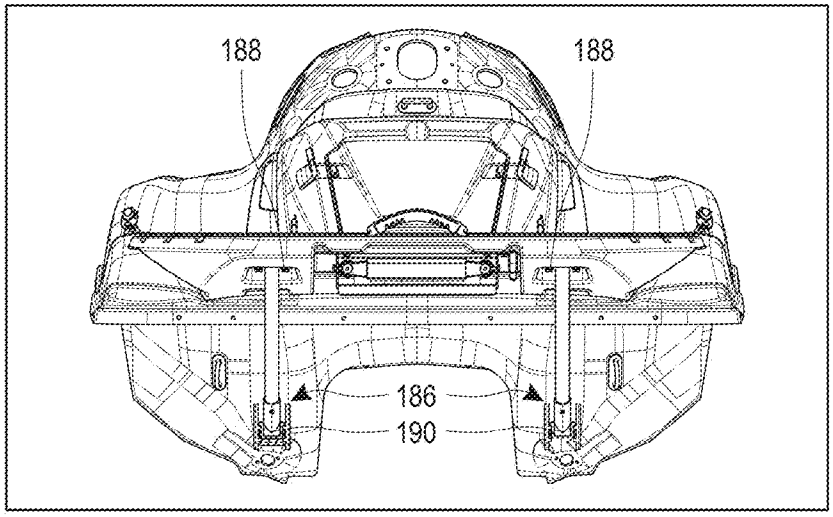
FIG. 16 is a rear elevational view of the deck extender of FIG. 13.
Figure 17:
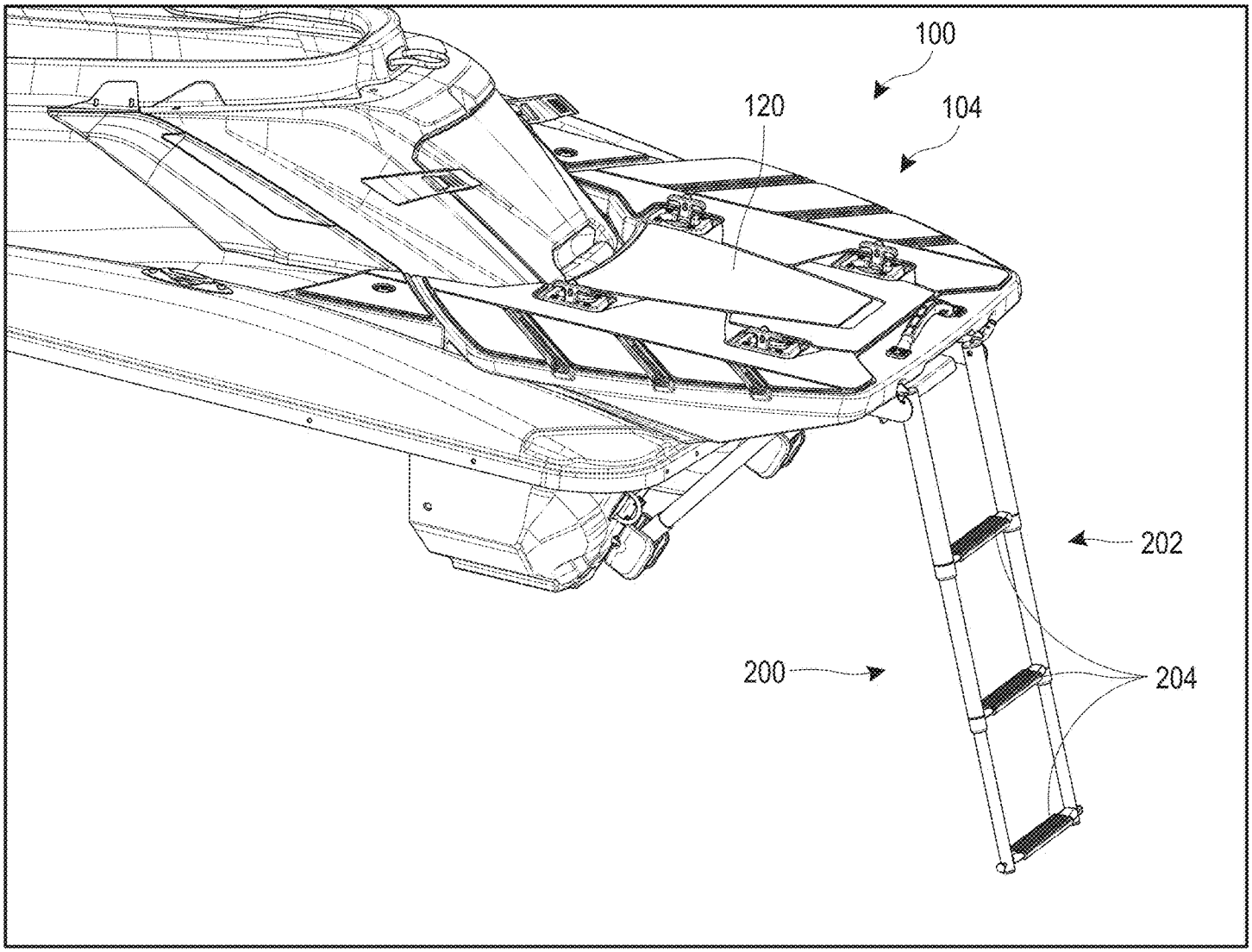
FIG. 17 is a top, rear, and left-side perspective view of another modification of the removable deck with an optional integrated telescoping boarding ladder in a deployed position.

With reference to FIG. 11, the lower support surface 125 of the removable deck member 104 can be considered as defining a footprint identified by the triple-thick line 161 which encompasses the outer periphery of the portions of the support surface 125 that make contact with the upper surface of the platform 8. Within the footprint 161, a contact patch 162, represented by light hatching in FIG. 11, is the portion of the support surface 125 that makes contact with the upper surface of the platform 8. As illustrated in FIG. 11, in some embodiments, the contact patch 162 includes portions that extend near or at the foremost portions of the footprint 161, the lateral most portions of the footprint 161, and rearward most portions of the footprint 161. Additionally, there are gaps, spaces, and discontinuities within the contact patch 162. However, in some embodiments, a contact patch 162 can be greater than 10% of the footprint. As noted above, the contact patch 162 can be 20% or more of the footprint 161.

Figure 9B:
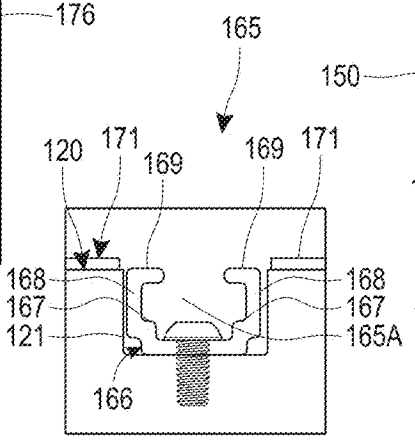
FIG. 9B is an enlarged, side elevational view of an optional mounting channel included on the deck extender.
Figure 9A:
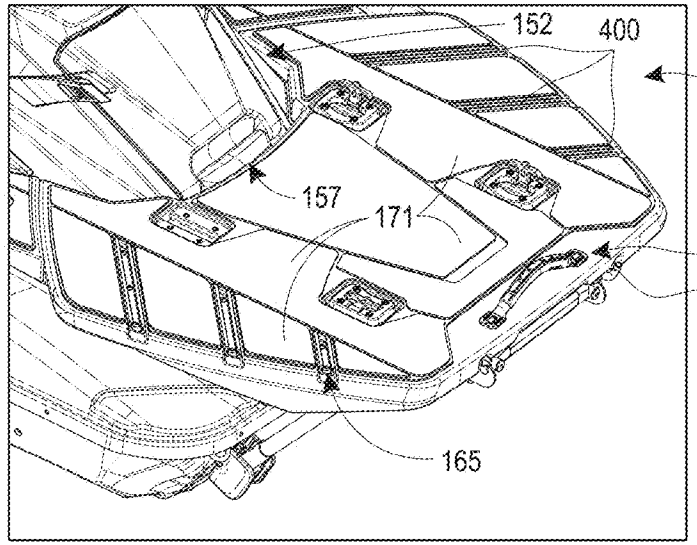
FIG. 9A is a top, rear, and left-side perspective view of the deck extender and sleeves, removed from the watercraft.

With continued reference to FIGS. 9A and 9B, the deck member 104 can also include one or more accessory mounting rails 165. The rails 165 can be configured for adjustably mounting accessories to the deck member 104. Such accessories can be mountable to the rails 165 with various different kinds of mechanisms.

In some embodiments, the rails 165 can include a lower channel portion 166 defining a recessed channel for receiving mounting fasteners. Additionally, the rail members 165 can include a lower support surface 167 extending to either side of the central channel 166. The rails 165 can also include upper side walls 168 and top wall portions 169, partially enclosing a central passage 165A. As such, the central passage 165A can capture a portion of a fastener used for securing an accessory to the rails 165.

For example, an accessory including a lug portion (not shown) that is wider than the space between top walls 169 can be inserted through an end of the rail 165 and slide to a desired location. Thereafter, a clamping mechanism can be used to press the lug within the passage 165A against lower surfaces of the top walls 169 and thereby clamp an accessory in place. Various different types of well-known clamping mechanisms can be used.

Figure 10:
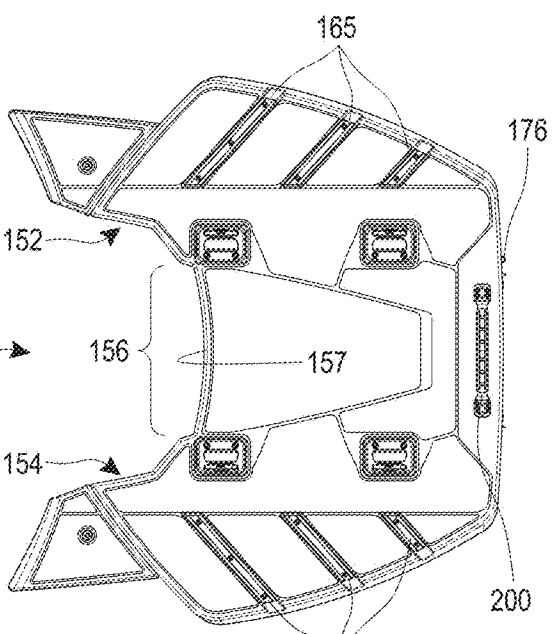
FIG. 10 is a top plan view of the deck extender and sleeves of FIG. 9.
Figure 12:
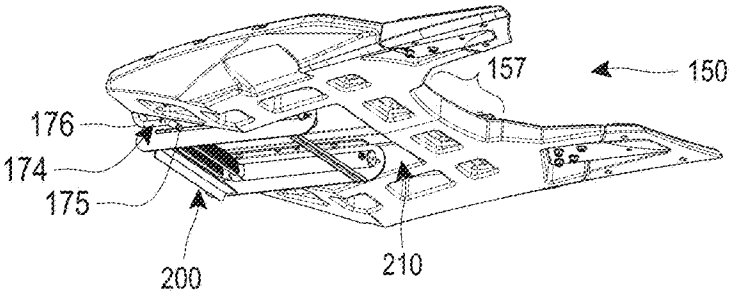
FIG. 12 is a front, bottom, and right-side perspective view of the deck extender and sleeves of FIG. 9.

With continued reference to FIGS. 9A and 10, the deck member 104 can include a plurality of rails 165 arranged in various locations and orientations. In the illustrated embodiment, the rails 165 are arranged in a rearwardly raked orientation such that the rails extend generally outwardly from the centerline of the deck member 104 and rearwardly when the deck member 104 is attached to a watercraft. As such, such an orientation of the rails 165 can help drain water that may have splashed into the rails 165.

With continued reference to FIGS. 5 and 9A, in some embodiments, the rails 165 can be recessed into channels formed in the upper surface 120 of the deck member 104. For example, the upper surface 120 of the deck extender can include one or more channels 121 configured to receive the rails 165.

With continued reference to FIGS. 9A, 9B, and 10, the deck member 104 can include matting 171 attached to the upper surface 120. For example, the matting 171 can be in the form of marine mat which is commonly used in the industry, for providing a comfortable padded surface that can withstand a marine environment. The matting 171 can be disposed adjacent to channels 121 and mounted so as to extend above the upper surfaces of the end walls 169 of the rails 165. Additionally, the marine mat can be cut to provide an aesthetically pleasing appearance having grooves and gaps between various pieces. Additionally, the grooves between pieces of marine mat can be oriented to enhance drainage of water that may be splashed onto the deck member 104.

With continued reference to FIGS. 9A, 10, 11, and 12, the deck member 104 can include a water conduit 174 mounted thereto. The water conduit can include a water inlet end 175 and a water outlet end 176. The water conduit 174 can be mounted to the deck member 104 with the water outlet end 176 disposed near an outer edge of the deck member. In the illustrated embodiment, the water outlet end 176 is disposed adjacent to the rear edge of the deck member. The water conduit 174 can be configured for producing an aesthetically pleasing spout of water during use. For example, the water inlet end 175 can be connected to the water passage 8B (FIG. 1) so as to receive pressurized water from the jet pump 7 during use. As such, the water conduit 174 can be used to bypass an original OEM water spout 8A that might be included on a personal watercraft to which the deck member 104 may be connected.

With reference to FIG. 8B, with the tabs 122, 124 received with in the mounting sleeve portions 106, 108, the mounting sleeve portions 106, 108 can resist uplift forces generated as a reaction to loads supported by the upper support surface 120. For example, when the deck member 104 is mounted as noted above, the lower surface 125 rests upon a portion of the upper surface of the platform 8. When a load L is applied to a portion of the upper surface 120 extending beyond the rear edge of the platform 8, the surface of the platform 8 can act as a fulcrum F, thereby causing an upward force $F_U$ to act on the tabs 120, 124. The upward force $F_U$ on the tabs is counteracted by the mounting sleeve portions 106, 108, and more specifically, the threaded fasteners holding the mounting sleeve portions 106, 108 to the platform 8.

As such, the rear portion 105 of the deck member 104 can extend out beyond the rear edge of the platform 8 by a cantilevered length 170. The cantilevered length 170 can be referred to as a cantilevered length of the rear portion 105. In some embodiments, the cantilevered length 170 can be at least 4 inches or more. In some embodiments, the cantilevered length is 6 inches, 8 inches, 10 inches, or 12 inches or more. As such, the upper surface 120 can provide a significant amount of additional, generally horizontal support surface for use by a user during various recreational activities with the structural, cantilevered support provided by the mounting sleeves that are attached only to portions of the watercraft 1 that are above the waterline.

In some embodiments, the deck member 104 is designed with sufficient strength to allow at least one human user to stand on the upper surface 120. For example, the deck member 104 can include tabs 122, 124 with sufficient strength and integrated into the deck member 104 such that an adult human weighing for example 200-300 pounds can stand at the rear edge of the deck member 104, approximately at the location of the load L (FIG. 8B) thereby causing a torque about the fulcrum F and thereby creating an upward force $F_U$ at the tabs 122, 124. As such, the mounting sleeves 106, 108 being secured to the platform 8, provide a downward force $F_D$ (FIG. 8B) resisting the torque created by the load L. The deck extender 103 can be formed with sufficient strength to withstand the torque generated by the load L. As such, the deck member 104 can provide an effective extension of the platform 8 of the watercraft, extending beyond the rear edge of the platform 8 by the cantilever distance 170 (FIG. 8B) without the need for additional, below the water line holes to be added to the watercraft 1.

In some embodiments, the deck member 104 can be made from lightweight materials, such as blow molded or spin casted plastic. In some embodiments, the deck member 104 can made from lighter-than-water material and/or can include internal voids and optionally be filled with foam so as to have a positive buoyancy.

FIGS. 13-16 illustrate a modification of the deck extender 100, identified by the reference numeral 100A, which includes an optional strut arrangement 180 configured to provide additional support for the cantilevered portion 105 of the deck extender 100A. For example, with reference to FIG. 19, the rear strut assembly 180 can include at least one strut assembly 182 extending from a portion of the personal watercraft 1 to a portion of the cantilevered length 170 of the removable deck member 104. In some embodiments the rear strut assembly 180 includes a right-side strut assembly 182 and a left-side strut assembly 184.

In some embodiments, each strut assembly 182, 184 includes a lower mount portion 186 configured to attach to a portion of the lower hull of the personal watercraft 1 and an upper mount portion 188 configured to engage the lower surface 125 of the removable deck member 104. For example, the upper mount portions 188 can be received within mounting recesses 191 provided in the lower surface 125. The mounting portions 188 can be fastened to the recesses 191 with threaded fasteners, or other types of fasteners.

The lower mounting portions 186 can be configured to be attached to the hull 2 of the personal watercraft 1. For example, in some embodiments, the lower mounting portions 186 can be secured to original-equipment mounting brackets 190 disposed on either side of the tunnel on the lower hull of the personal watercraft.

In some personal watercraft 1, mounting brackets 190 are provided as original equipment with factory-installed through-hull fittings for securing the brackets 190 to the hull 2. In some personal watercraft, the brackets 190 are used to secure a folding boarding step 8C (FIG. 1) for assisting a user in re-mounting the personal watercraft 1 from the water. Thus, when using the removable deck extender 100, the factory-included folding boarding step 8C can be removed while leaving the mounting brackets 190 and securing the struts 182, 184 to the existing brackets 190. As such, the strut assembly 180 can provide additional support for the cantilevered portion 105 of the removable member 104, without the need of any additional below-the-water-line, through-hull fittings.

With continued reference to FIGS. 13-17, the removable deck extender 100, 100A can further include an optional retractable ladder assembly 200. In some embodiments, the retractable ladder assembly can include a telescoping side tube assembly 202 with a plurality of cross bars 204 that act as rungs of the ladder when extended.

Figure 20:
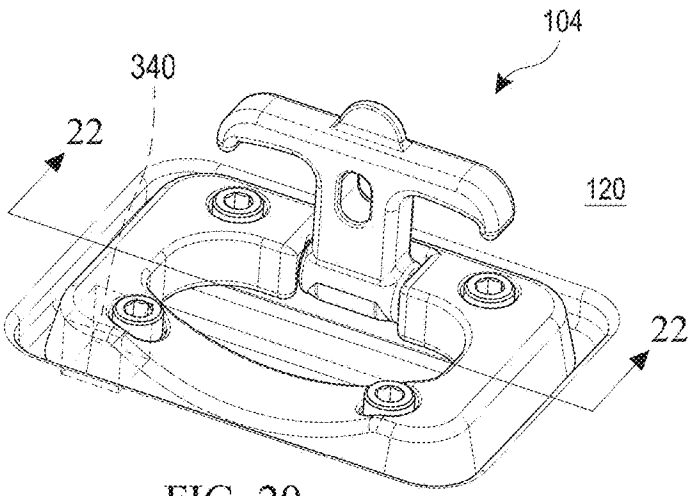
FIG. 20 is an enlarged perspective view of the mounting assembly of FIG. 19 in an open state.
Figure 21:
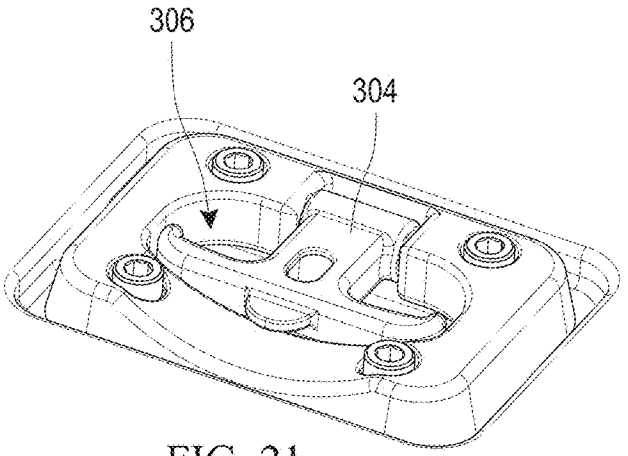
FIG. 21 is an enlarged perspective view of the mounting assembly of FIG. 19 in a closed state.
Figure 18:
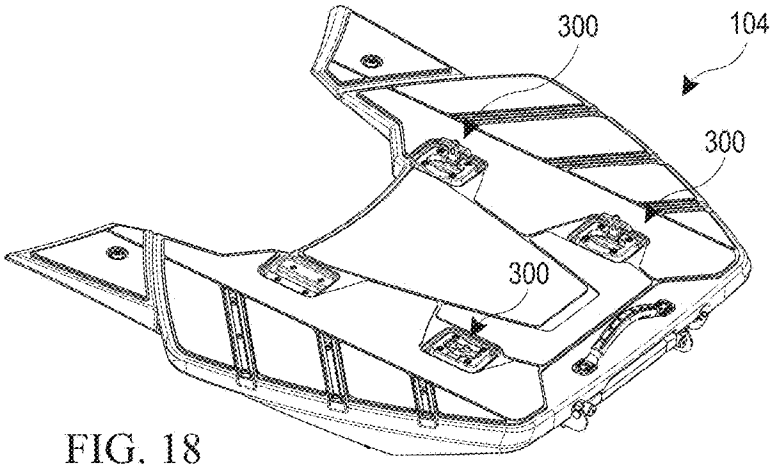
FIG. 18 is an enlarged top, rear, and left-side perspective view of an area of the removable deck including four mounting assemblies.
Figure 22:
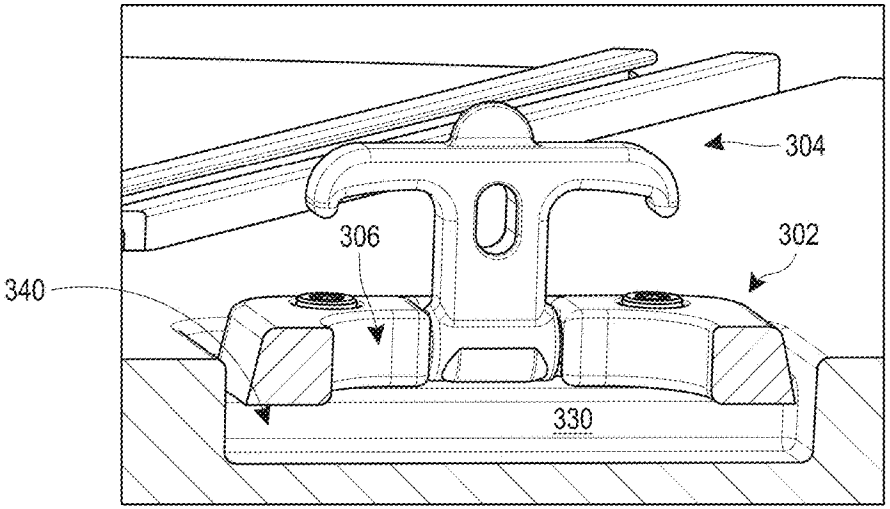
FIG. 22 is a sectional view of the mounting assembly of FIG. 19 as viewed along the cross section 22.-22. of FIG. 20 in an open state.

Optionally, the removable deck member 104 can include a ladder channel 210 (FIGS. 12 and 15) configured to receive the telescoping ladder assembly 200. For example, the channel 210 can be a generally rectilinear channel provided in the lower surface 125 of the deck member 104. As such, the channel 210 forms a pocket with the upper surface of the platform 8 when the deck member 104 is installed onto a personal watercraft 1. Thus, in the stowed state (FIGS. 12 and 15) the ladder assembly 200 is largely enclosed by the lower surface 125 and the upper surface of the platform 8. The configuration and structure of telescoping ladder assemblies, such as the ladder assembly 200 illustrated in FIGS. 20-22 are well known in the art. Other types of ladder assemblies can also be used.

With reference to FIGS. 18-21, the removable deck member 104 can optionally include mounting mechanisms configured to provide mounting locations for additional cargo or accessories. In the illustrated embodiment, the removable deck member 104 includes four mounting mechanisms 300 arranged in a spaced apart orientation with two mechanisms 300 being disposed towards the front end of the removable deck member 104 and two mounting mechanisms 300 disposed towards a rear end of the removable deck member 104. Other arrangements of mounting mechanisms and number of mounting mechanisms can also be used.

Figure 19:
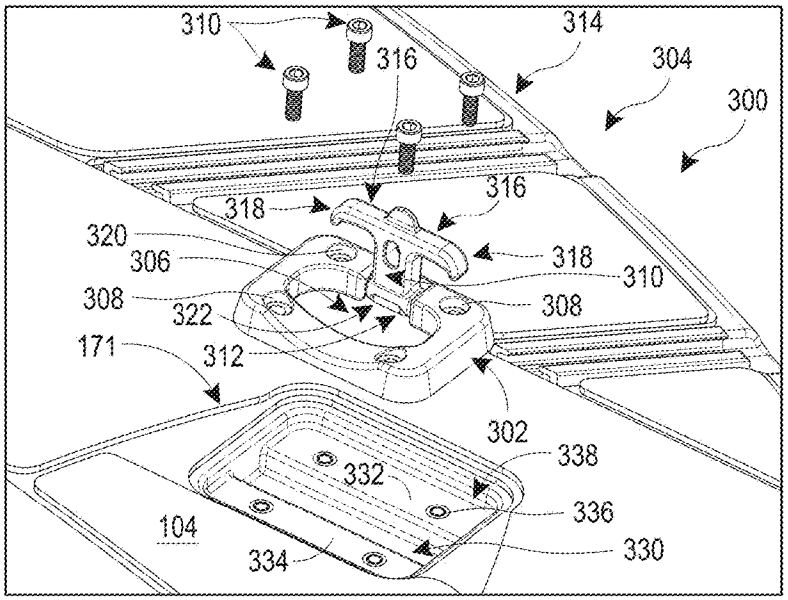
FIG. 19 is an enlarged, perspective, and exploded view of a mounting mechanism of the removable deck of FIG. 18.

With reference to FIG. 19, the mounting mechanism 300 can include a frame member 302 and an anchor member 304. The anchor member 304 can be mounted for movement between a stowed position (FIG. 21) and a deployed position (FIGS. 19 and 20).

In the illustrated embodiment, the frame member 302 extends generally circumferentially around a center aperture 306. Additionally, the frame member 302 includes a plurality of fastener apertures 308 configured to received threaded fasteners 310 for securing the frame member 302 to the removable frame member 104.

The anchor member 304 can have any shape and optionally is shaped for engaging with securement devices, such as ropes, bungee cords, bungee cord hooks, straps, etc. In the illustrated embodiment, the anchor member 304 is in the shape of a cleat.

The cleat 304 can include a central stem portion 310 having a lower end 312 connected to the frame member 302 and an upper end 314. The upper end 314 can include a pair of extension arms 316 extending laterally away from the central stem 310. The arms 316 can be configured to provide engagement surfaces for the securement devices noted above. Additionally, optionally, the arms 316 can include lateral ends 318, with downturned tips, which can be configured to provide further engagement with securement devices.

Optionally, the stem member 310 can include a central aperture 320. The central aperture 320 can be sized to receive securement devices, such as bungee hooks, ropes, etc. A hinge pin mechanism (not shown) can connect the lower end 312 of the anchor member 304 to the frame member 302.

Optionally, the anchor member 304 can include a detent mechanism 322 configured to bias the anchor member 304 in the stowed position (FIG. 21) and the deployed position (FIG. 20). For example, the detent mechanism 322 can include a detent member and a spring biasing the detent member to a position projecting outwardly from an outer surface of the lower end 312, at a location offset from the bottom surface of the lower end 312 thereby creating an over-center interaction with another surface, in a well-known manner.

Optionally, the mounting mechanism 300 can be secured over a mounting recess 330 defined in the removable deck member 104. For example, optionally, the recess 330 can be smaller, in at least one dimension, than the bottom surface of the frame member 302 and extend under at least a portion of the bottom surface of the frame member 302. For example in the illustrated embodiment, the recess 330 is generally channel-shaped, defining a concave channel disposed adjacent to support surfaces 332, 334. The two support surfaces 332, 334 can be sized so as to support the bottom surface with portions of the frame member 302 and can include apertures 336 aligned with the apertures 308 of the frame member 302, and thereby configured to receive the threaded fasteners 310, when assembled.

With the recess 330 positioned as such, a portion of the frame member 302 overlies an open upper end of the recess 330, thereby creating a receptacle 340 beneath the frame member 302 and within the channel 330. For example, with reference to FIG. 20, when assembled, the frame member 302 and the recess 330 form a receptacle 340, therebetween. The receptacle 340 can be used for optional modes of operation for securing accessories to the mounting mechanism 300.

With continued reference to FIGS. 20 and 21, when the anchor member 304 is in the stowed position, the stem 310 and arms 316 fit within the aperture 306. As such, the anchor member 304 can be oriented in a position in which it is essentially flush with the frame member 302 when in a stowed position.

Additionally, optionally, the recess 330 and surfaces 332, 334, can be further recessed from the upper surface 120 of the removable deck member 104. For example, with reference to FIG. 19, the recess 330 and surfaces 332, 334 can be disposed within a further recess 338 which can have a depth approximately equal to a height of the frame member 302. Thus, when mounted in the orientation illustrated in FIG. 21, the upper surface of the frame member 302 is substantially flush with the surrounding upper surface 120 of the removable deck member 104.

Further, optionally, as noted above, the deck member 104 can include matting 171 disposed around the recess 330 and/or the recess 338. In some embodiments, the recess 338 is sized such that the upper surface of the frame member 302 is flush or substantially flush, or recessed from the upper surface of the matting 171 surrounding the mounting mechanism 300.

Figure 23:
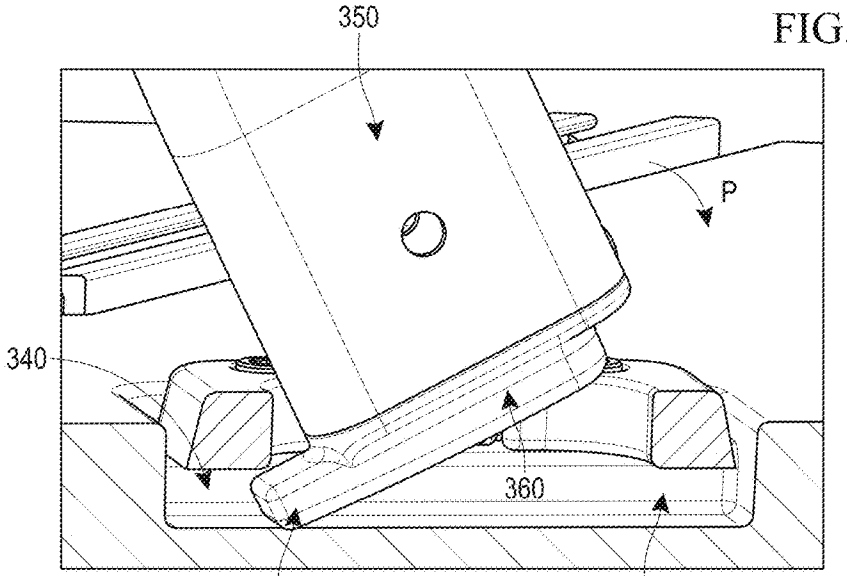
FIG. 23 is a sectional view of the mounting assembly in FIG. 22 with a support leg partially inserted into the mounting assembly.
Figure 24:
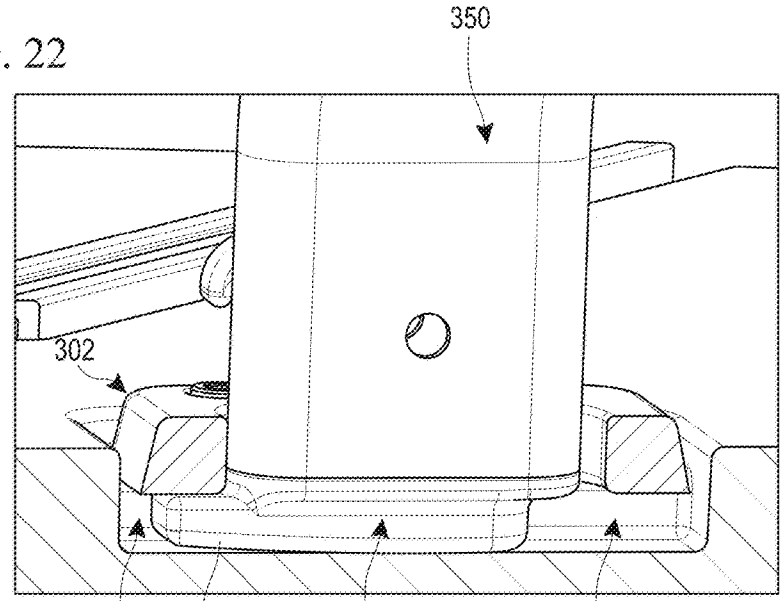
FIG. 24 is a sectional view of the mounting assembly with a mounting leg fully inserted.

FIGS. 22-24 illustrate an optional use of the receptacle 340. As shown in FIG. 22, the frame member 302 is mounted over the recess 330, forming a receptacle 340. As noted above, the receptacle 340 can be used in optional configurations for mounting an accessory. For example, FIG. 23 includes an illustration of an optional structure for an accessory, including a leg 350 and a mounting toe 352 extending from a lower end of the leg 350. The mounting leg 350 can be provided on the lower end of any of a variety of different kinds of accessories, an example of which is described below with reference to FIGS. 28-33.

In the illustrated embodiment, the mounting leg 350 comprises a cross-section that is smaller than the aperture 306 of the frame member 302. Thus, the lower end of the mounting leg 350 can fit within the aperture 306.

Additionally, the mounting leg 350 includes a foot portion 360 extending from a lower end of the mounting leg 350. In some embodiments, the foot 360 can have a longitudinally extending shape generally complementary to the recess 330. For example, in some embodiments, the foot 360 can have a width approximately equal to and/or slightly smaller than the width of the recess 330. As such, the fit between the foot 360 and the recess 330 can provide for a more positive registration therebetween, in use.

With continued reference to FIG. 23, in use, the support leg 350 can be inserted through the aperture 306 and then the toe portion 352 can be tucked under a portion of the frame member 302, into the receptacle 340. Then, the support leg 350 can be pivoted downwardly in the direction of arrow P to the position illustrated in FIG. 24. As shown in FIG. 24, the toe portion is captured within the receptacle 340 by portion of the frame member 302. As such, any upward movement of the support leg 350 would be limited by the frame member 302. Additionally, with a close fit between the outer surfaces of the foot and the recess 330 movements in other directions would also be limited.

Figure 26:
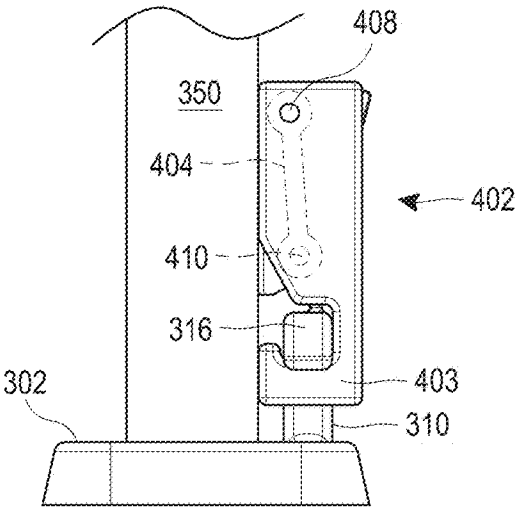
FIG. 26 is a rear elevational view of the over-center clasp of FIG. 25 in a closed state.
Figure 25:
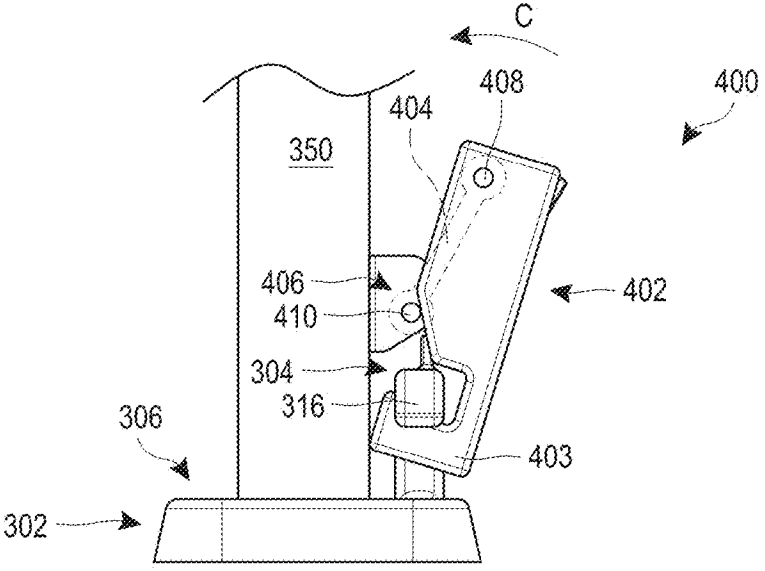
FIG. 25 is a rear elevational view illustrating an optional over-center clasp mechanism securing a mounting leg to the mounting mechanism of FIGS. 18-21, in an open state.
Figure 27:
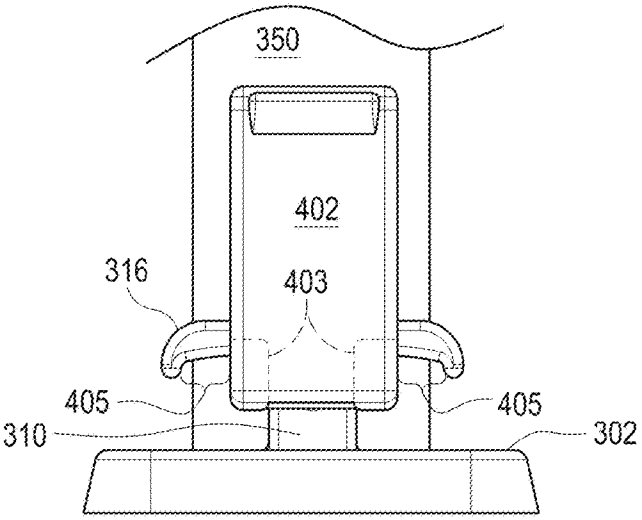
FIG. 27 is a side elevational view of a mounting leg secured by the over-center clasp, and illustrating additional clearance between the over-center clasp mechanism and the ends of a cleat portion of the mounting mechanism.
Figure 29:
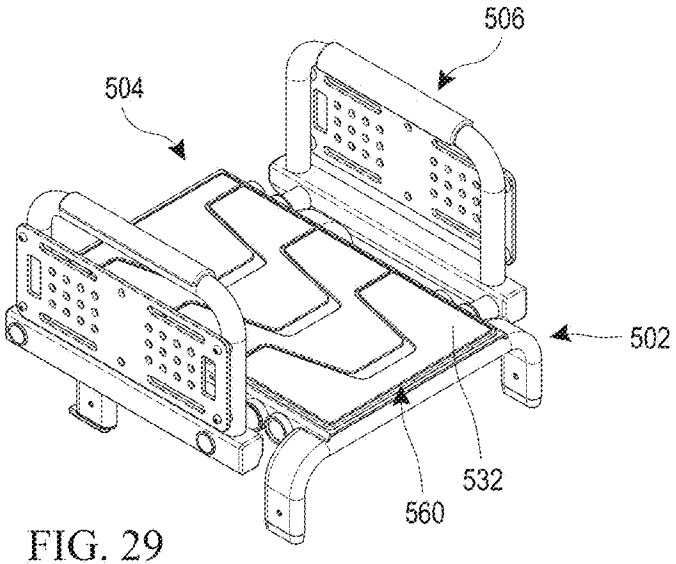
FIG. 29 is a top, rear, and left-side perspective view of the rack of FIG. 28 removed from the watercraft.

With reference to FIGS. 25-27, additional anchoring devices can be used for preventing upward or pivoting movement of a support leg 350 relative to the mounting mechanism 300. For example, a clasp mechanism 400 can be used to secure the anchor member 304 to a portion of the support leg 350. In some embodiments, the clasp mechanism 400 can be configured to provide resistance against pivoting of the support leg 350 relative to the mounting mechanism 300. In some embodiments, the clasp 400 can be configured to provide securement with additional bias or tension holding the leg or foot 360 seated against the lower surface of the recess 330. In some embodiments, the clasp mechanism can be configured to operate according to the over-center principle of operation.

For example, in some embodiments, the clasp mechanism 400 can include a draw hook portion 402 with one or more hook members 403, a lever member 404 and a base portion 406. The draw hook portion is connected to the lever member 404 at a drop hook pivot 408. The lever member 404 can be connected directly to the base 406 at a base pivot 410. Optionally, one of the draw hook portion 420 or the lever member 404 can be slightly elastic. As such, the clasp mechanism 400 can be configured to deform the elastic one of the draw hook portion 420 or the lever member 404 so as to cause stretching or compression to thereby provide a biasing force. The structure and operation of such over-center clasp mechanisms are well known in the art.

With continued reference to FIG. 25, the clasp mechanism 400 can be configured to, in an open position illustrated in FIG. 25, have sufficient slack such that the draw hook portion can engage the arms 316 of the anchor member 304. In this position, the distance between the end of the draw hook 402 and the pivot 410 is a first distance.

With reference to FIGS. 25 and 26, as the draw hook 402 is pushed in the direction of arrow C, the draw hook pivot passes 408 over the base pivot 410, thereby pulling the end of the draw hook 402 upwardly against the arm 316 of the anchor member and compressing the lever member 404. Because the base pivot 408 is now on the other side of the draw hook axis, the clasp 400 is in the over-centered, locked position with the lever member 404 pressing downwardly on the base 406 and thereby pushing the bottom of the foot 360 against the bottom of the recess 330.

In some embodiments, with reference to FIG. 27, the draw hook 402 can be configured with sufficiently narrow hook members 403 that additional clearance 405 is left at the outer lateral ends of the arms 316 so as to provide additional clearance for securing additional rope or hooks when the clasp member 400 is in use.

With reference to FIGS. 28-31, the deck extender 100 can be used for supporting a variety of different devices. One example of an accessory that can be connected to the deck extender 100 is a rack assembly 500. The rack assembly 500 can include a support frame assembly 502, a support surface assembly 504, and optionally, a side wall assembly 506.

Figure 30:
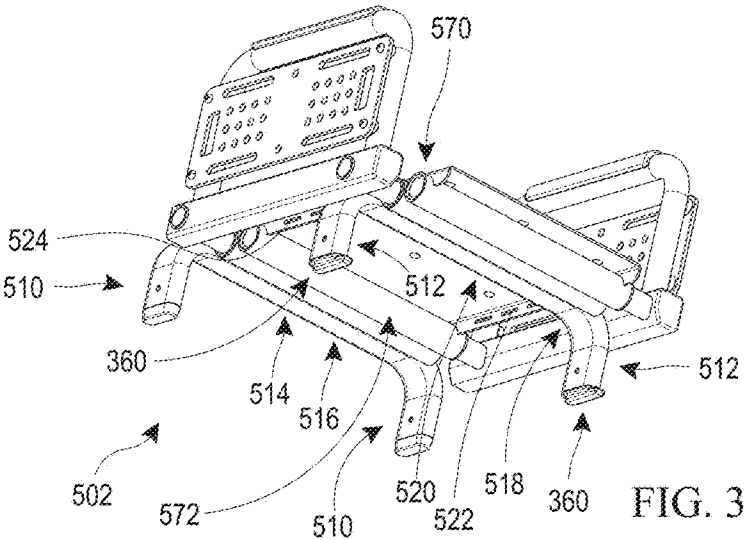
FIG. 30 is a bottom, front, and right-side perspective view of the rack of FIG. 28.

With reference to FIG. 30, the support frame assembly 502 can include one or more support legs 510. In the illustrated embodiment, the support frame assembly includes a pair of front legs 512 and a pair of rear legs 510. In some embodiments, the rear leg members 510 can be formed from a rear leg member 514 having a generally U-shaped configuration with the ends of the leg member 514 forming the leg portions 510. A central portion 516 of the leg member 514 connects the leg portions 510.

Similarly, the front legs 512 can be formed as the ends of a front leg member 518 with a central portion 520 thereof connecting the leg portions 512. In some embodiments, the front leg portions 512 can include foot portions 360 described above with reference to FIGS. 23 and 24. The frame assembly 502 can also include side members 522, 524 connecting the rear and front leg members 514 and 518.

The support platform 504 can include a support member 530 and can optionally include an arrangement of one or more pieces of matting 532 which can be in the form of marine mat and can optionally include borders, spaces, or gaps defining an aesthetically pleasing appearance. The support member 530 can be connected to the leg members 514, 518 and/or the lateral frame members 522, 524 so as to rigidly support the support member 530 relative to the legs 510, 512.

Figure 31:
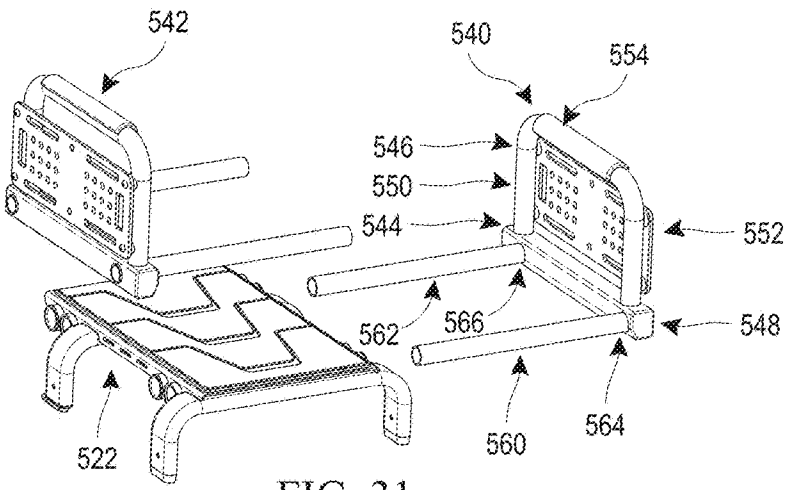
FIG. 31 is a top, rear, and left-side perspective view and left-side perspective exploded view of the rack of FIG. 28.
Figure 28:
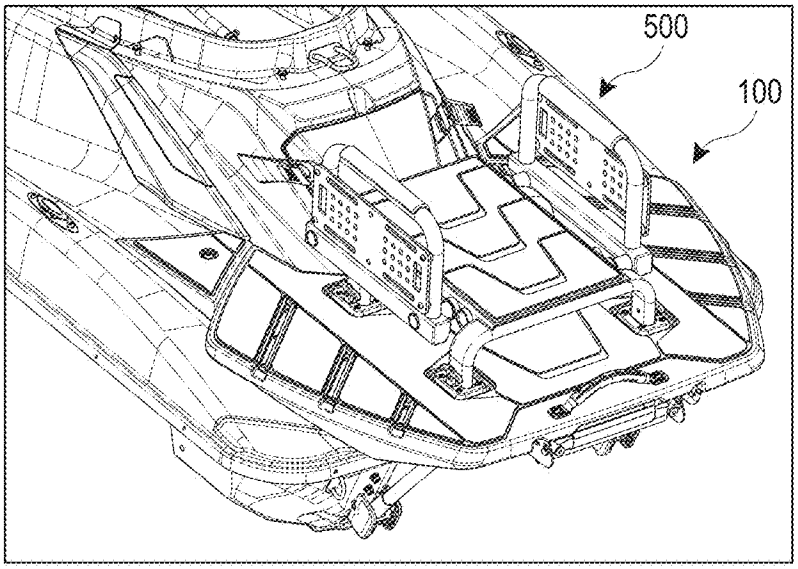
FIG. 28 is a top, rear, and left-side perspective view of an optional rack assembly connected to the removable deck.

With reference to FIG. 31, the side wall assembly 506 can be formed of one or side wall portions 540. Optionally, the side wall assembly 506 can include a first side wall portion 540 and a second side wall portion 542. Optionally, in some embodiments, one or both of the side wall portions 540, 542 are configured to be adjustably mounted relative to the support assembly 504, for example to be laterally adjustable relative to the support portion 504.

In some embodiments, each of the support portions include a base member 544. The base member 544 can be a structural member having any cross section or design. Additionally, the side wall portions 540, 542 can include one or more super structure members 546 extending upwardly from the base member 544. In the illustrated embodiment, the super structure member 546 is a generally U-shaped member having a tubular cross section.

First and second ends 548, 550 of the super structure member 546 are attached to the base member 544. Additionally, the super structure member 546 extends upwardly from the first and second ends 548, 550 to a longitudinally extending portion 552 which connects the first and second end portions 548, 550. The super structure member 546 extends upwardly and generally perpendicular to the support surface portion 504, so as to define a side wall relative to the support portion 504.

Optionally an accessory mounting plate 552 can be attached to the super structure portion 546. The accessory mounting plate 552 can include a plurality of apertures, different sizes of apertures, different arrangements of apertures, so as to provide a variety of different kinds of mounting options for mounting other accessories, tools, or devices thereto. Additionally, the super structure member 546 can include an optional mat 554 attached to an upper surface thereof, for example, for providing a comfortable gripping surface for a user.

The base member 544 can be fixed to or slidably engaged with the frame assembly 502. For example, in some embodiments, the side wall portion 540 includes one or more laterally extending support members 560, 562. The members 560, 562 can include first ends 564, 566 secured to the base member 544. Additionally, the members 560, 562 can have a length sufficient for permanent, fixed connection to the support frame assembly 502 or for sliding or adjustable engagement with the frame portion 502.

For example, in some embodiments, the rack assembly 500 can include one or more receiver tubes 570, 572 fixed to the frame assembly 502 and configured to receive the members 560, 562 for sliding engagement therein. The lengths of the members 560, 562 and receiver tubes 570, 572 can be set to provide the desired amount of lateral adjustability of the side wall portions 540, 542. Optionally, the rack 500 can include hand operable clamps (not shown) for allowing the side wall portions 540, 542 to be adjusted laterally, and locked into desired positions. Additionally, the rack assembly 500 can include a limiter assembly including a mechanism configured to prevent the wall portions 540, 542 from being pulled completely out of the receiver tubes 570, 572 without unlocking a locking mechanism or limiter mechanism with tools.

Figure 32:
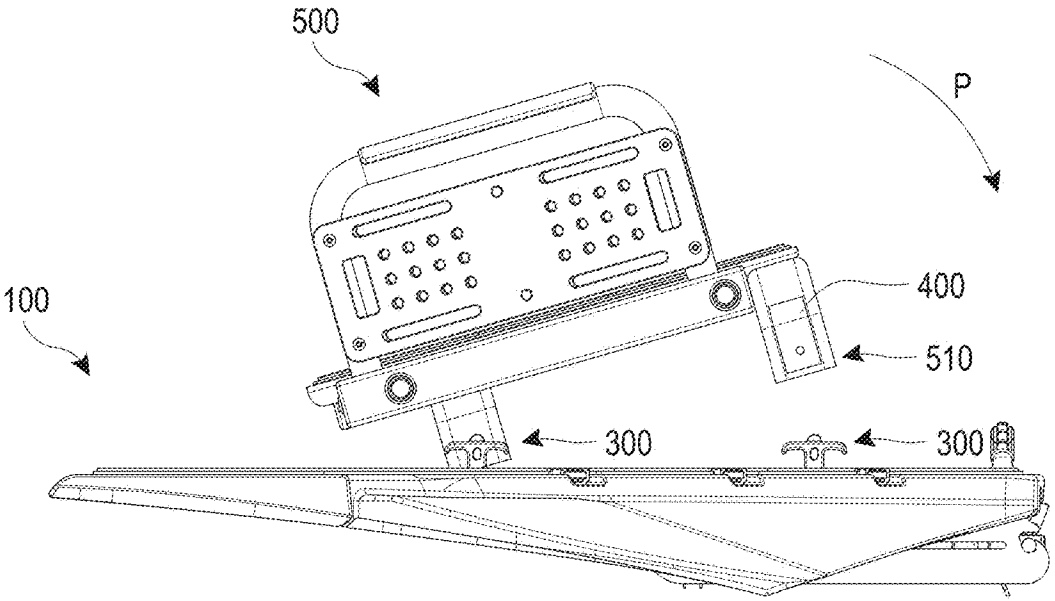
FIG. 32 is a side elevational view of the rack partially engaged with the removable deck during an installation procedure.
Figure 33:
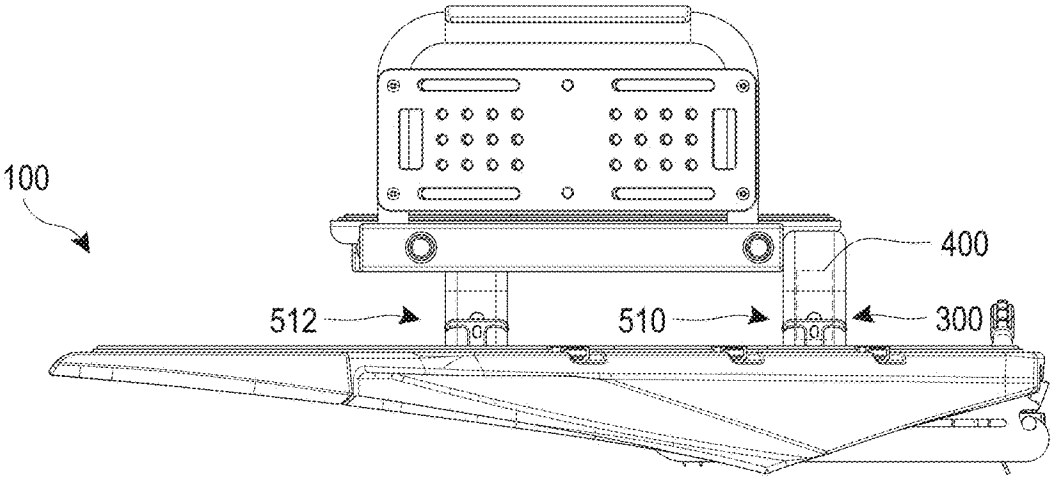
FIG. 33 is a side elevational view of the rack fully seated to the removable deck.

With reference to FIGS. 32 and 33, as noted above, the front legs can include feet 360 described above with reference to FIGS. 23 and 24. Thus, the rack assembly 500 can be secured to the deck extender 100 by first moving the rack assembly 500 into the orientation illustrated in FIG. 32, with the toes 352 of the feet 360 inserted into the receptacles 340 (FIGS. 23-24), then the rack assembly can be pivoted downwardly in the direction of arrow P until the rear legs 510 move through the apertures 306 of the rearward mounting assemblies 300, as illustrated in the orientation illustrated in FIG. 33.

Optionally, the clasp mechanisms 400 can be used to secure the rear legs 510 to the rear mounting assemblies 300, thereby preventing upward movement of the rear legs 300 relative to the deck extender 100. Thus, with the rear legs 510 secured against upward movement by way of the clasp mechanisms 400, the front legs 512 are secured against upward movement by the movement of the toes 352 in the receptacles 340. In some embodiments, clasp mechanisms 400 can be provided on the front legs 512 as well.

In some embodiments, the deck member 104 and mounting sleeves 106, 108 can be packaged together and sold as kit for adding the deck extender 100 to a personal watercraft.

Figure 34:
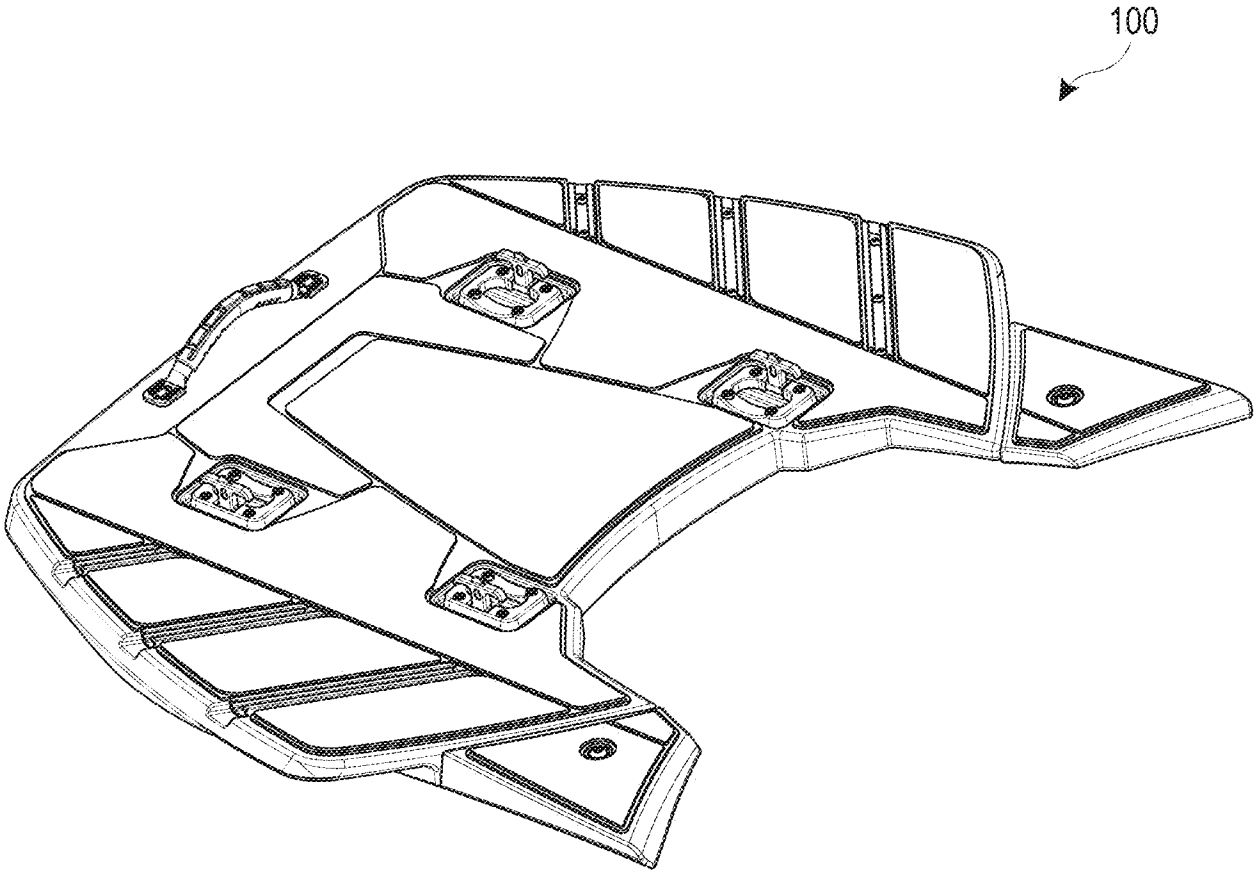
FIG. 34 is a top, front, and right-side perspective view of an optional aesthetically pleasing design for the removable deck.
Figure 35:
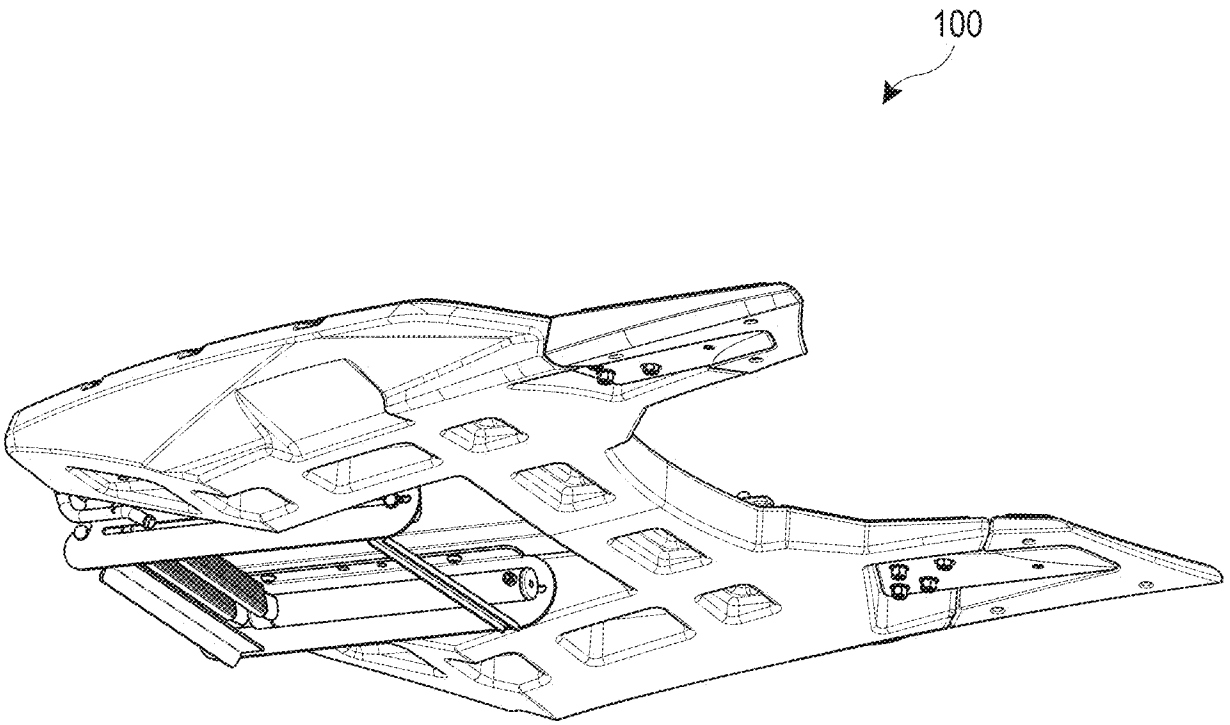
FIG. 35 is a top, rear, and right-side perspective view of the removable deck of FIG. 34.
Figure 36:
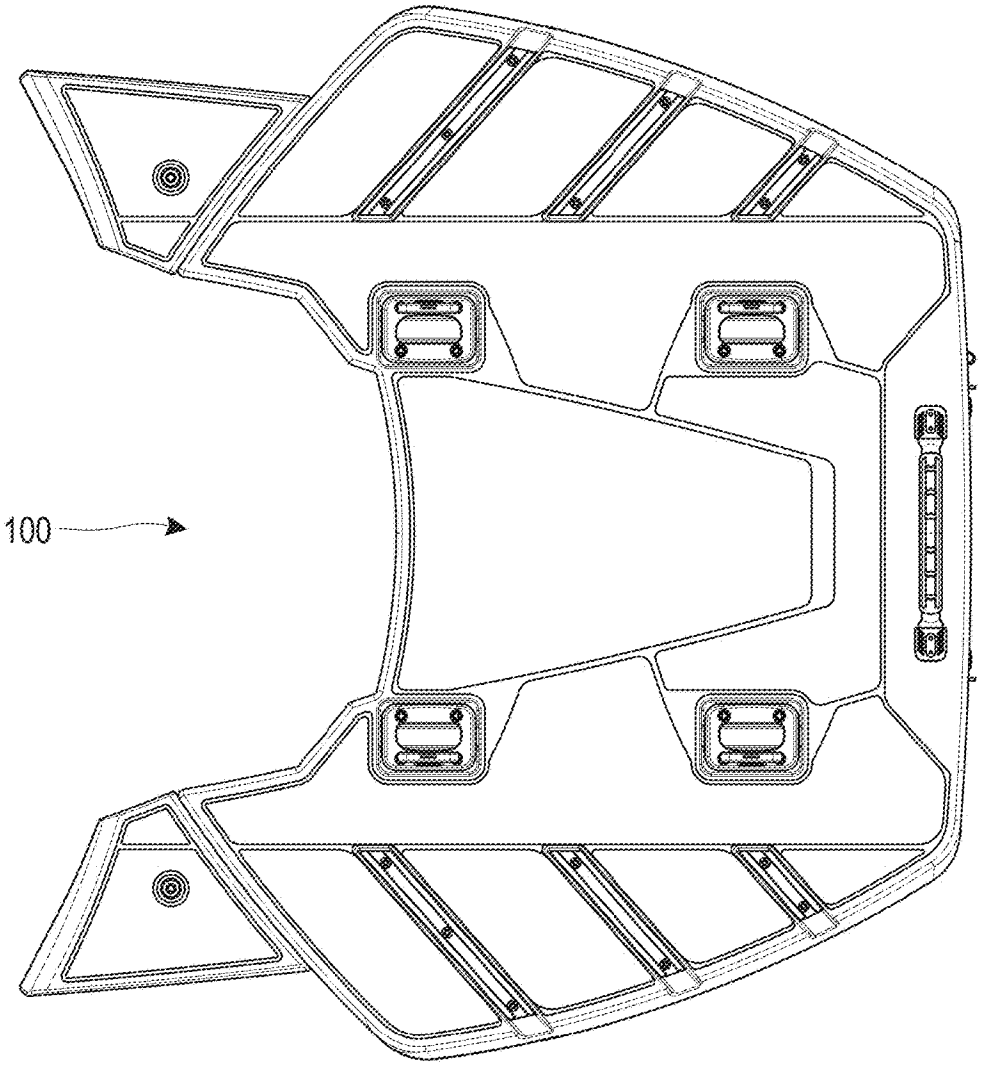
FIG. 36 is a top plan view of the removable deck of the embodiment of FIG. 34.
Figure 37:
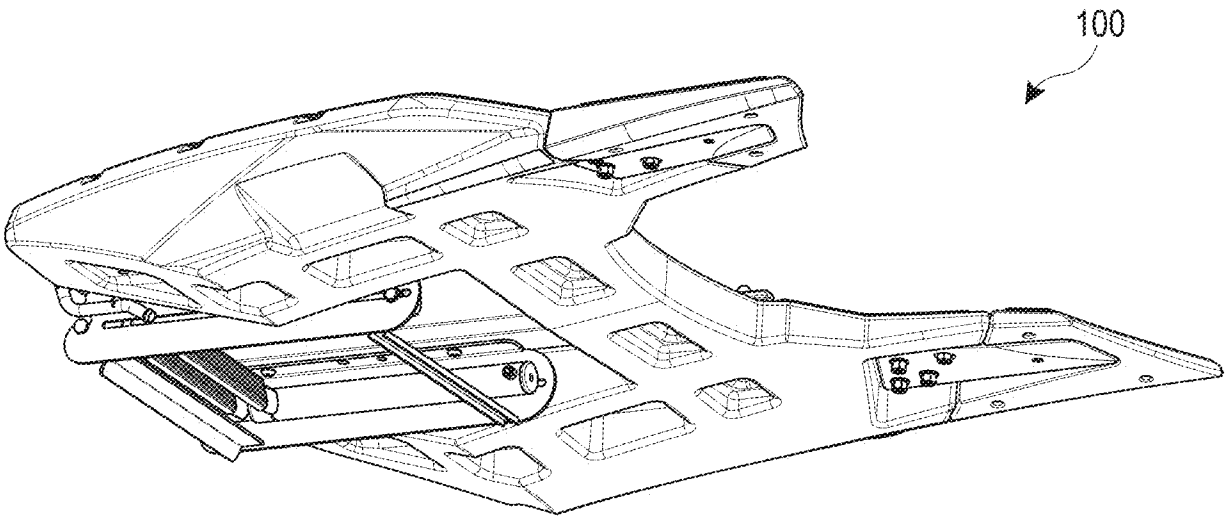
FIG. 37 is a bottom, front, and right-side perspective view of the embodiment of FIG. 35.
Figure 38:
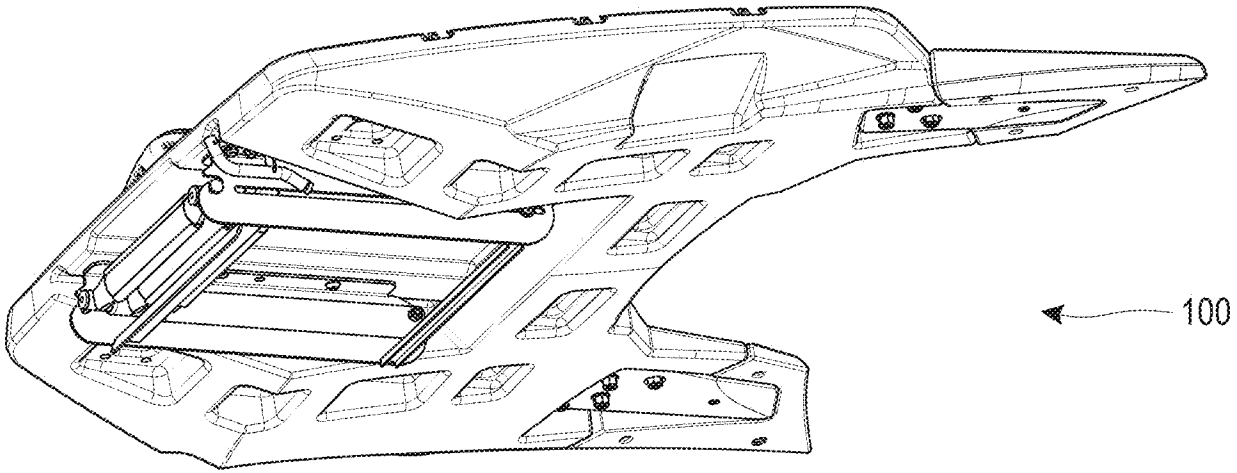
FIG. 38 is a bottom, rear, right-side perspective view of the embodiment of FIG. 34.
Figure 39:
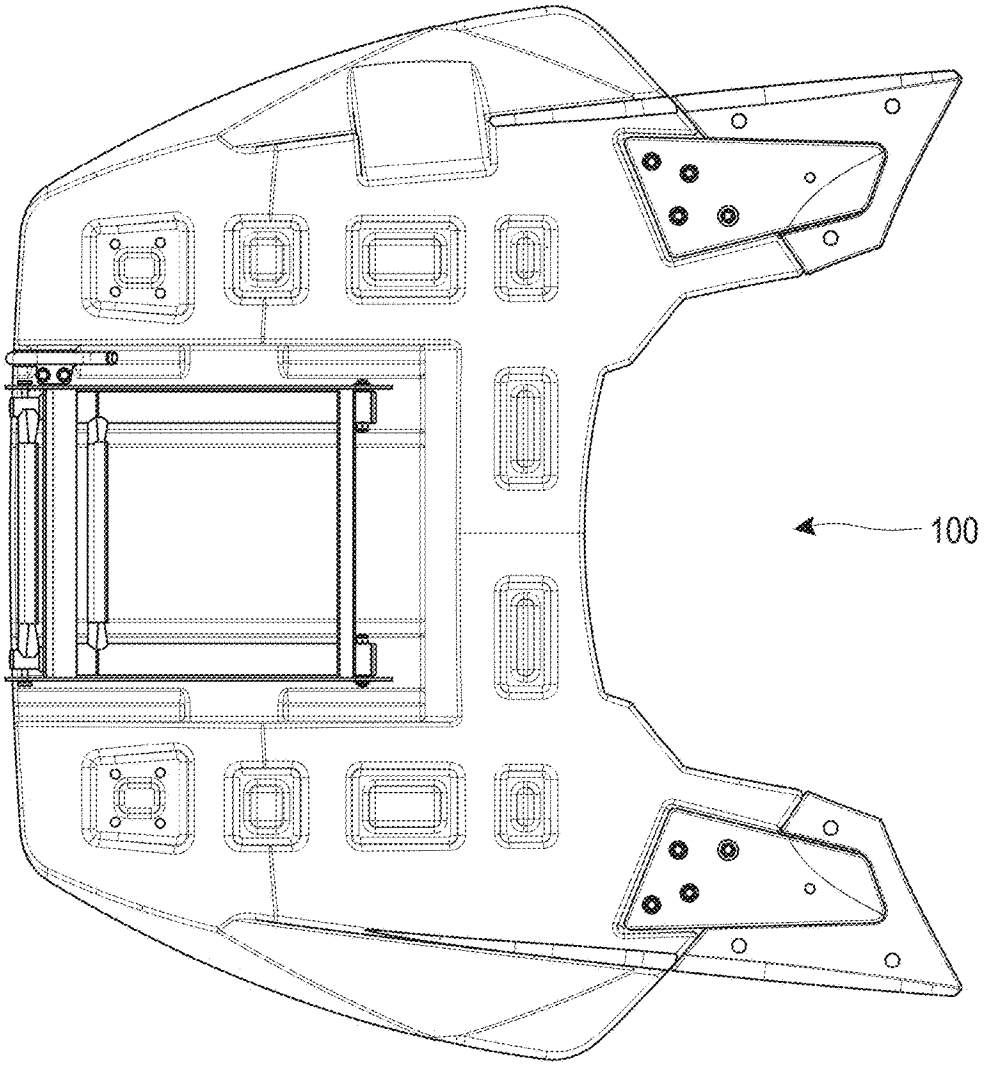
FIG. 39 is a bottom plan view of the embodiment of FIG. 34.
Figure 40:
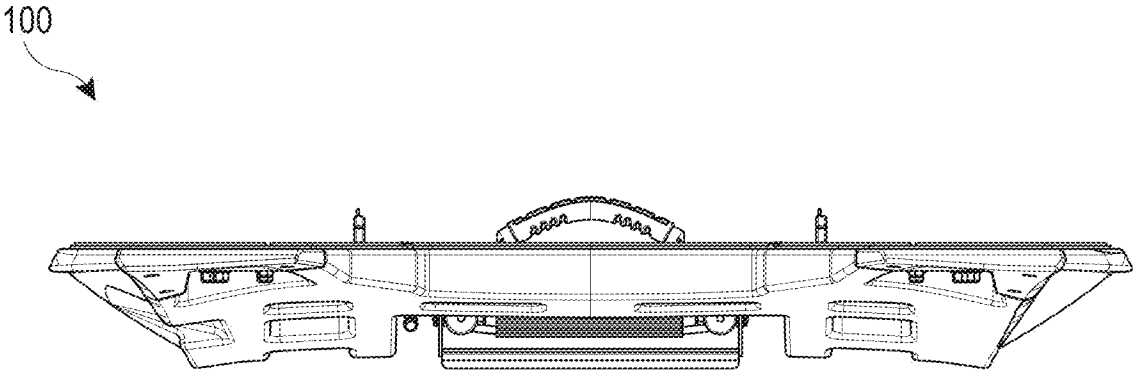
FIG. 40 is a front elevational view of the embodiment of FIG. 34.
Figure 41:
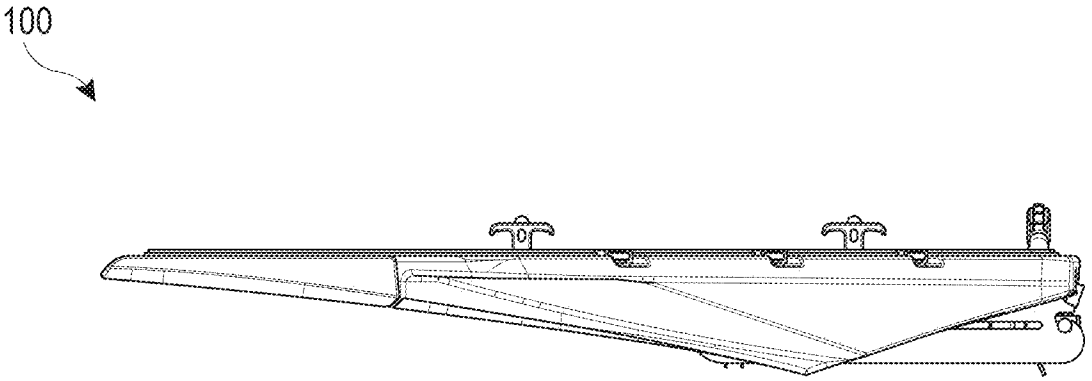
FIG. 41 is a left-side elevational view of the embodiment of FIG. 34.
Figure 42:
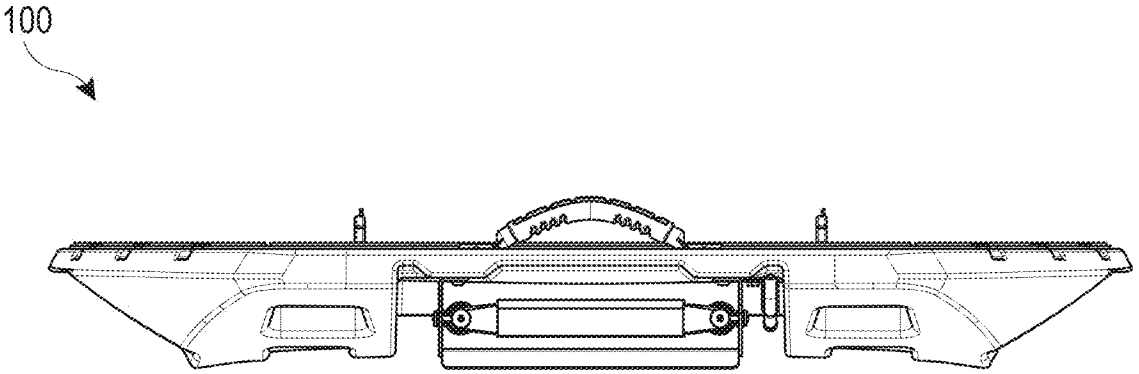
FIG. 42 is a rear elevational view of the embodiment of FIG. 34.
Figure 43:
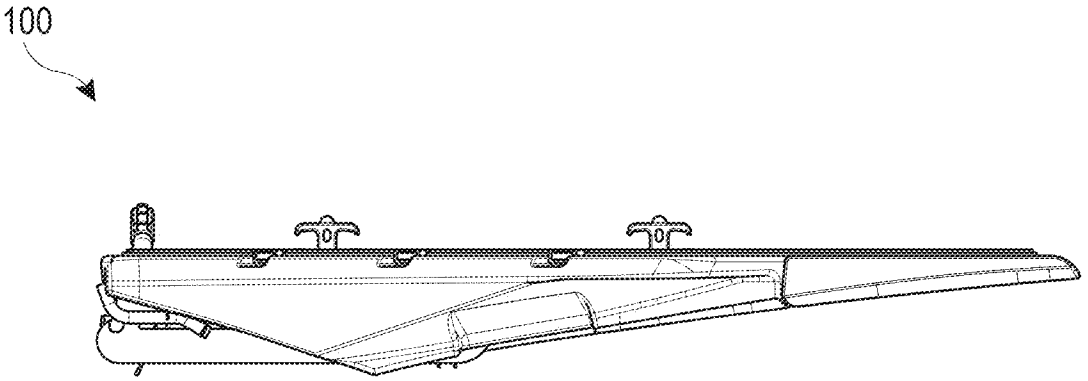
FIG. 43 is a right-side elevational view of the embodiment of FIG. 34.
Figure 44:
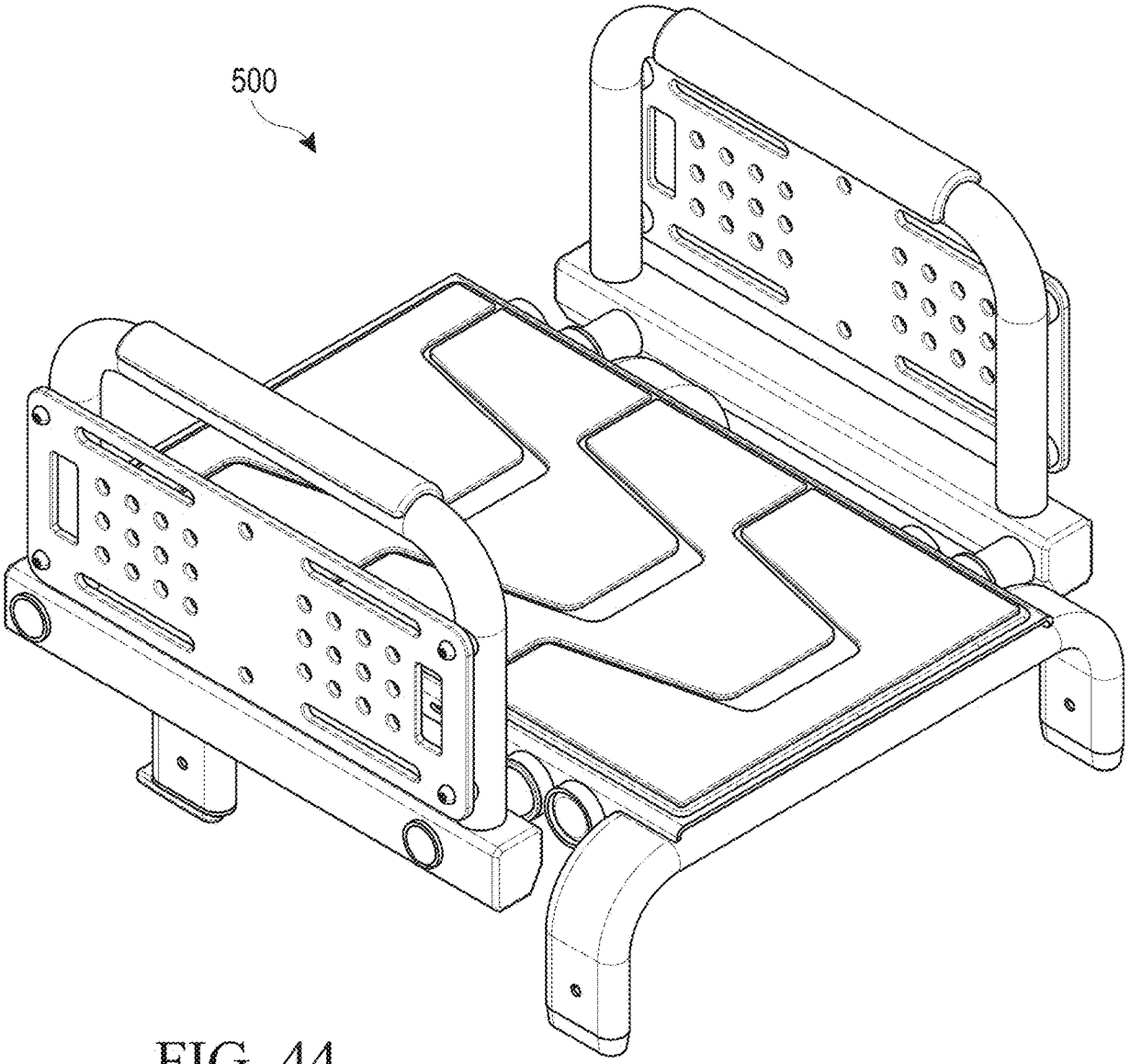
FIG. 44 is a top, rear, and left-side perspective view of an aesthetically pleasing embodiment of a rack.
Figure 45:
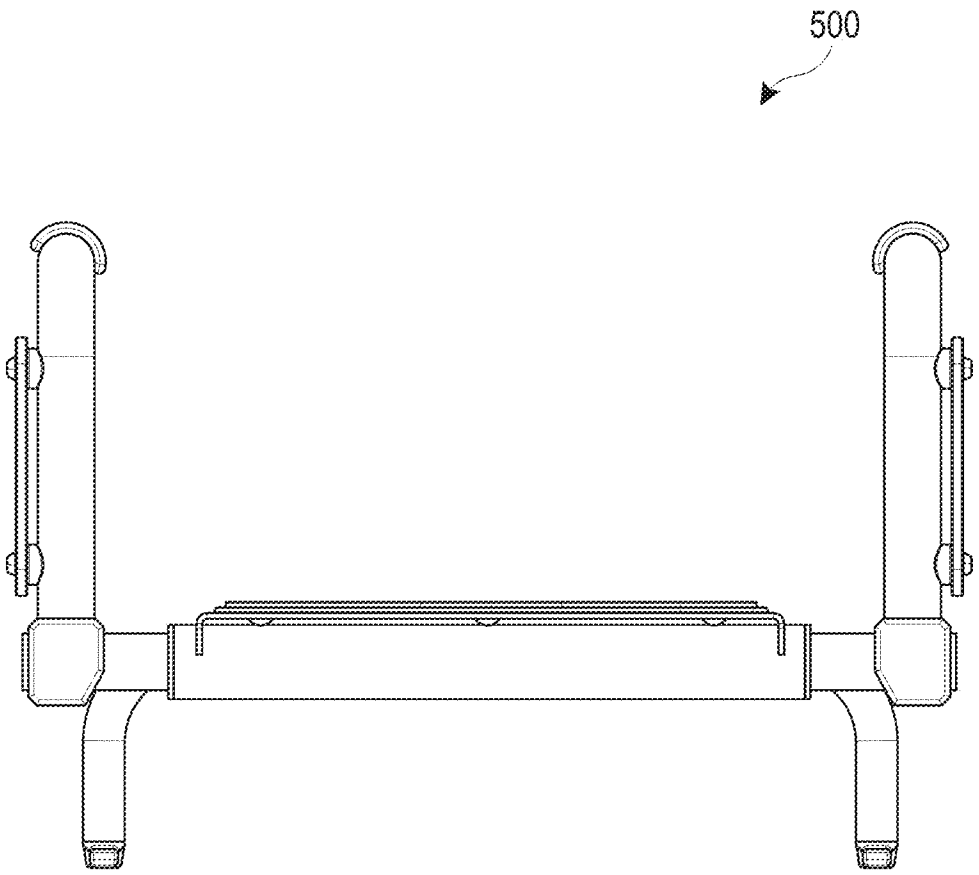
FIG. 45 is a front elevational view of the embodiment of FIG. 44.
Figure 46:
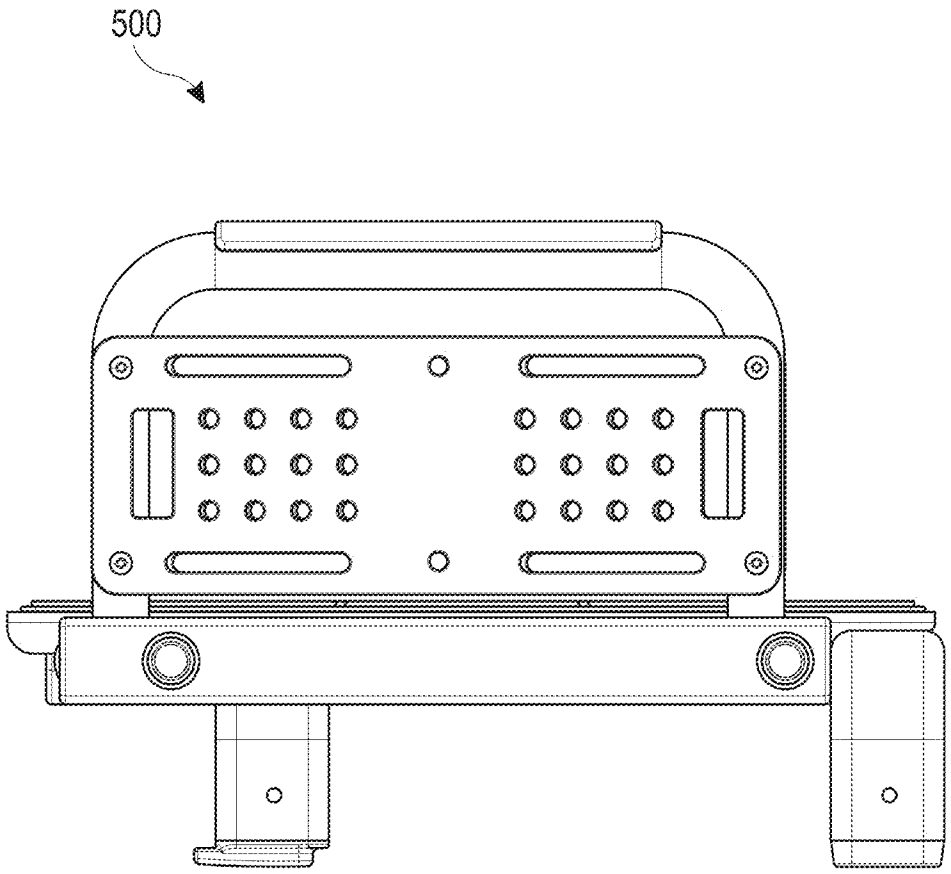
FIG. 46 is a left-side elevational view of the embodiment of FIG. 44.
Figure 47:
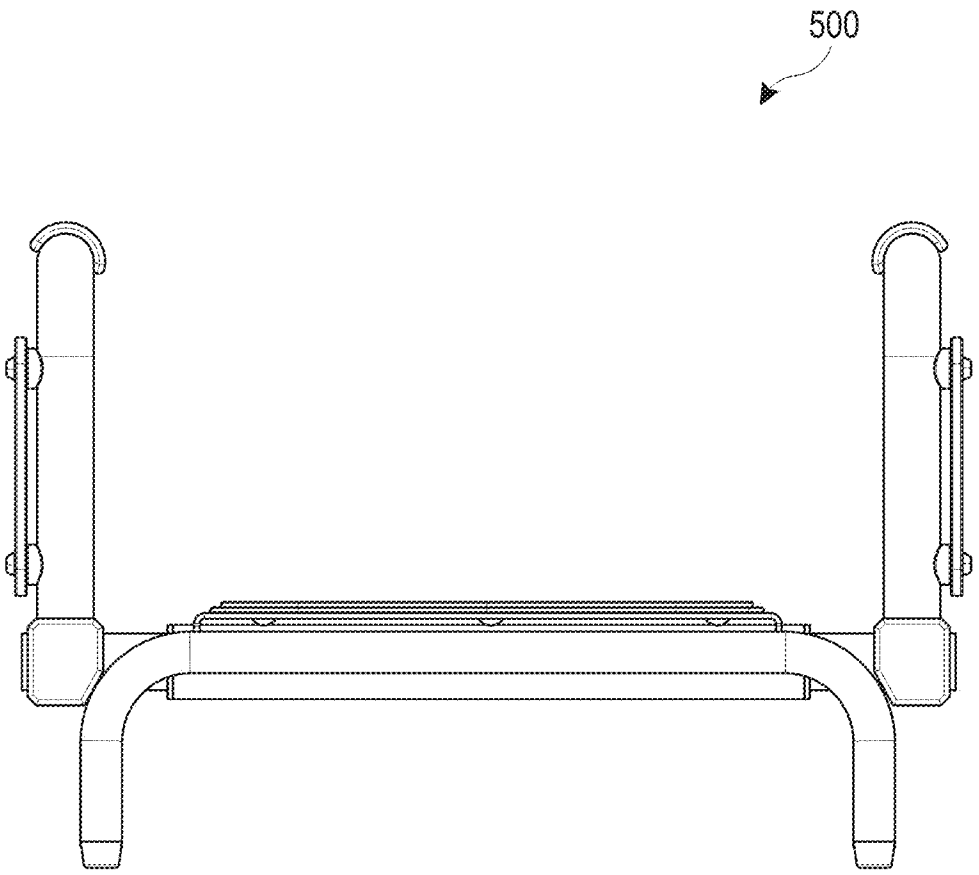
FIG. 47 is a rear elevational view of the embodiment of FIG. 44.
Figure 48:
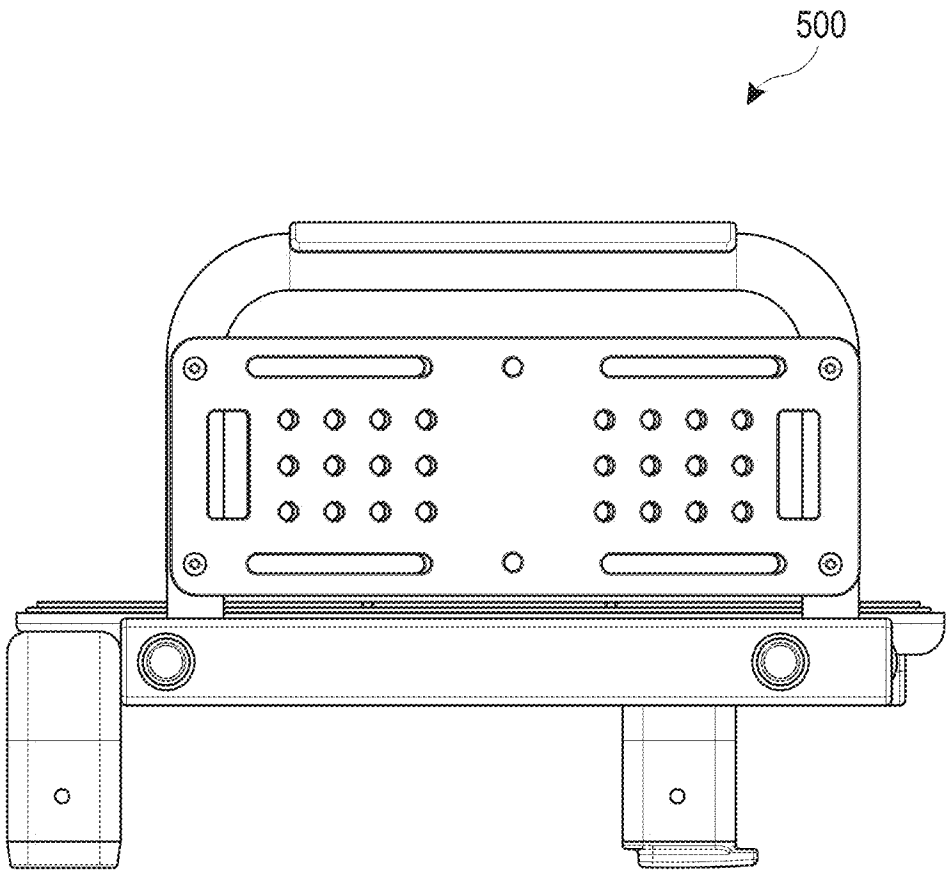
FIG. 48 is a right-side elevational view of the embodiment of FIG. 44.
Figure 49:
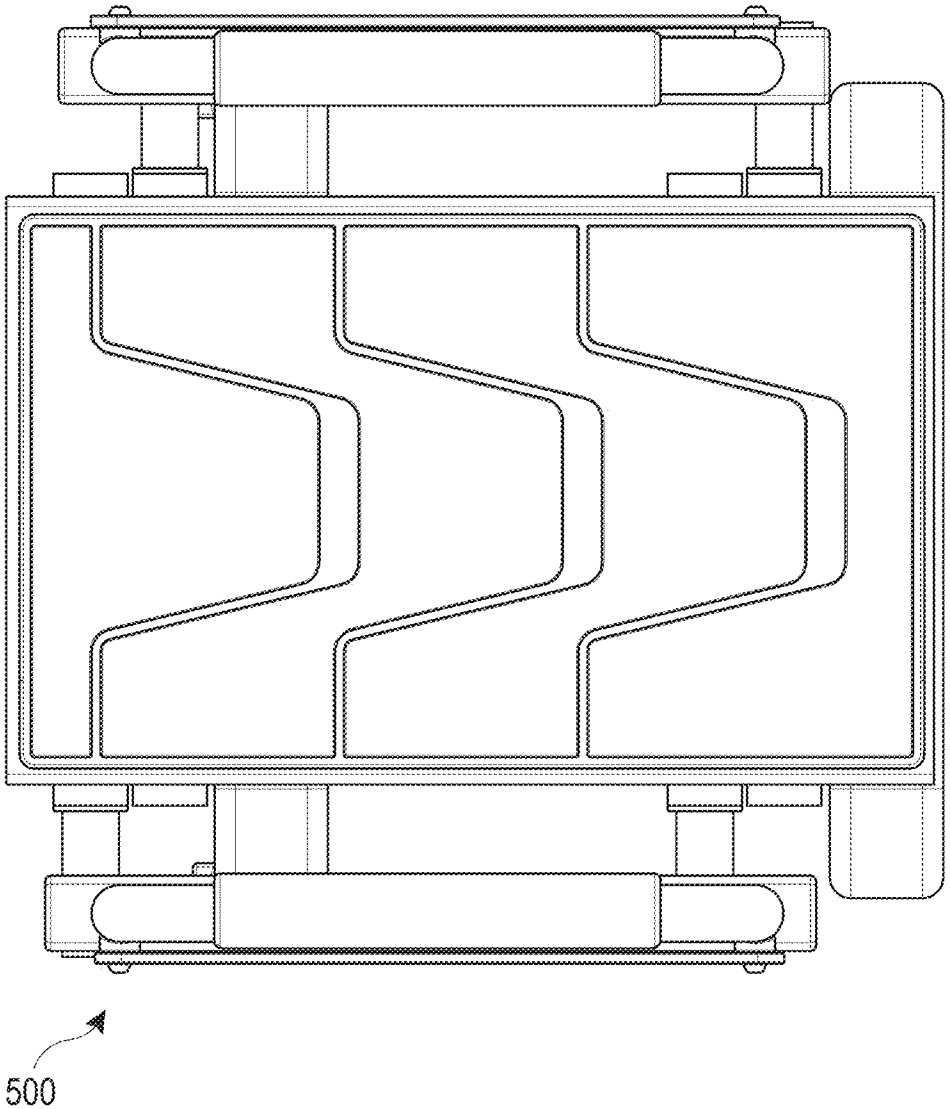
FIG. 49 is a top plan view of the embodiment of FIG. 44.
Figure 50:
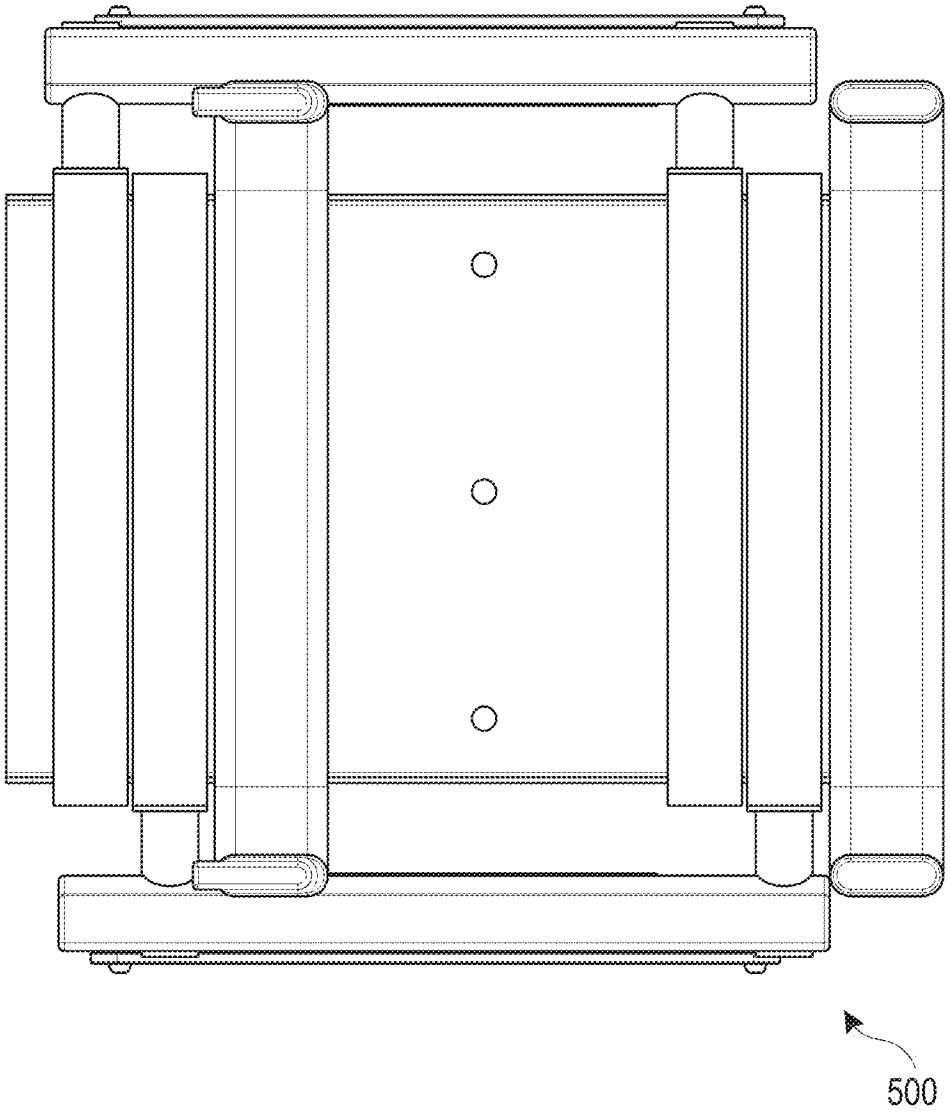
FIG. 50 is a bottom plan view of the embodiment of FIG. 44.
Figure 51:
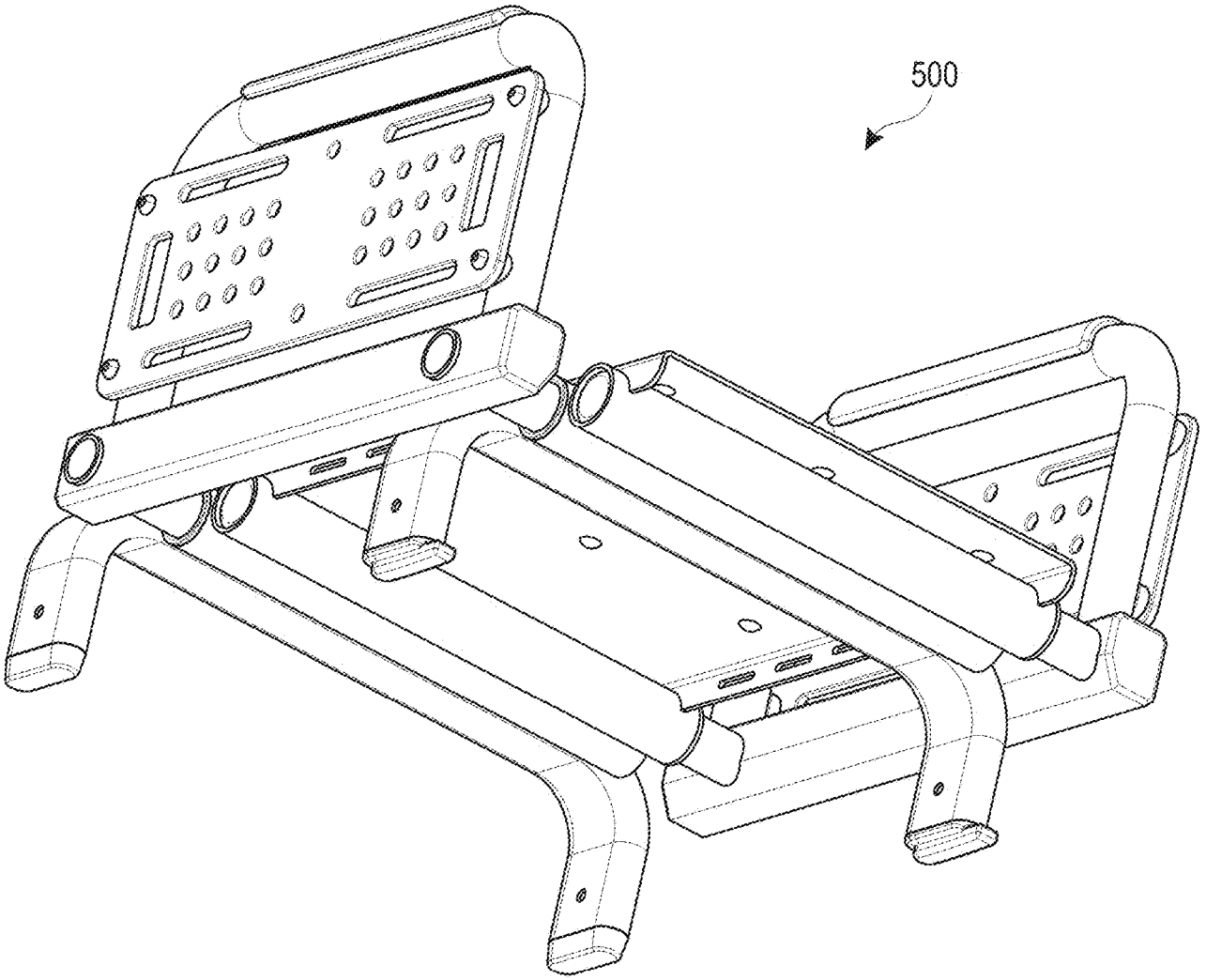
FIG. 51 is a bottom, front, and right-side perspective view of the embodiment of FIG. 44.

FIG. 34 illustrates optional, aesthetically pleasing features of the deck extender 100.

FIGS. 44-51 illustrate optional, aesthetically pleasing aspects of the rack assembly 500.

Although embodiments of the present inventions have been described above, the present inventions are not limited to the embodiments described above, and various modifications are possible within the scope of the inventions. It is to be understood that variations and modifications will be apparent to those skilled in the art without departing the scope and spirit of the present inventions.

What is claimed is:

1. A personal watercraft comprising:

a cargo-carrying surface; and at least one anchor rail mounted on a surface of the personal watercraft, the at least one anchor rail being adjacent to the cargo-carrying surface and exposed to an environment, wherein the at least one anchor rail comprises an outwardly facing surface exposed to the environment, and the at least one anchor rail is secured to the personal watercraft in such a manner that the outwardly facing surface is recessed relative to the cargo-carrying surface to form a recess or that the outwardly facing surface is flush with the cargo-carrying surface.

2. The personal watercraft according to claim 1, further comprising a seat on which a user sits, wherein the personal watercraft includes a seat support supporting the seat and wherein the cargo-carrying surface is located rearward of the seat and faces upward.

3. The personal watercraft according to claim 2, wherein the at least one anchor rail mounted on the surface of the personal watercraft is located rearward of the seat.

4. The personal watercraft according to claim 1, wherein the cargo-carrying surface faces upward, the recess is a downward recess, and the cargo-carrying surface comprises a region located outward of the at least one anchor rail in a left-right direction.

5. The personal watercraft according to claim 1, wherein the at least one anchor rail includes a pair of anchor rails extending in at least a front-rear direction and spaced apart from each other in a left-right direction.

6. The personal watercraft according to claim 5, wherein the pair of anchor rails further extend in left-right direction.

7. The personal watercraft according to claim 5, wherein the pair of anchor rails are arranged in a rearwardly raked orientation such that the pair of anchor rails extend generally outwardly from a centerline of the personal watercraft.

8. The personal watercraft according to claim 1, wherein the at least one anchor rail is recessed in a channel associated with the surface of the personal watercraft.

9. The personal watercraft according to claim 1, wherein the surface of the personal watercraft corresponds to a surface of a deck extender fixed to the personal watercraft.

10. The personal watercraft according to claim 1, wherein the at least one anchor rail defines a recessed channel for receiving mounting fasteners.

11. The personal watercraft according to claim 1, wherein the at least one anchor rail includes upper side walls and top wall portions, wherein the upper side walls and the top wall portions partially form a central passage.

12. The personal watercraft according to claim 1 further comprising at least one mounting mechanism formed on the surface of the personal watercraft.

13. The personal watercraft according to claim 12 further comprising four mounting mechanisms arranged in a spaced apart orientation on the surface of the personal watercraft.

14. The personal watercraft according to claim 13, wherein the four mounting mechanisms are arranged with two mechanisms being disposed towards a front end of the surface of the personal watercraft and two mounting mechanisms disposed towards a rear end of the surface of the personal watercraft.

15. A personal watercraft comprising:

a cargo-carrying surface; and at least one anchor rail mounted on a surface of the personal watercraft, the at least one anchor rail being adjacent to the cargo-carrying surface and exposed to an environment, wherein the at least one anchor rail includes a pair of anchor rails extending in a front-rear direction and spaced apart from each other in at least a left-right direction.

16. The personal watercraft according to claim 1, wherein the at least one anchor rail includes a pair of anchor rails extending in at least a left-right direction and spaced apart from each other in a front-rear direction.

17. The personal watercraft according to claim 16, wherein the pair of anchor rails further extend in a front-rear direction.

18. A personal watercraft comprising:

a cargo-carrying surface; and at least one anchor rail mounted on the personal watercraft, the at least one anchor rail being adjacent to the cargo-carrying surface and exposed to an environment, wherein the personal watercraft includes at least one receiving groove in which the at least one anchor rail is placed, wherein a longitudinal length of the receiving groove is greater than a longitudinal length of the at least one anchor rail, and wherein a longitudinal end of the at least one anchor rail is located closer to a center of the personal watercraft than a longitudinal end of the receiving groove in a direction along the longitudinal length of the receiving groove.

19. The personal watercraft according to claim 18, wherein the at least one anchor rail includes a pair of anchor rails extending in at least one of a front-rear direction or a left-right direction.

20. The personal watercraft according to claim 18, wherein the at least one anchor rail comprises:

a receiving plate exposed to the environment outside the watercraft; and a slit formed in the receiving plate and extending in a longitudinal direction of the at least one anchor rail.

21. The personal watercraft according to claim 20, wherein the at least one anchor rail comprises a rail main portion comprising the receiving plate and the slit and defining an anchor space, the anchor space communicating with the environment through the slit and extending in the longitudinal direction of the at least one anchor rail.

22. The personal watercraft according to claim 21, further comprising a fastener securing the at least one anchor rail to the personal watercraft.

23. The personal watercraft according to claim 22, wherein the at least one anchor rail includes a lower channel portion, the lower channel portion defining a recessed channel for receiving the fastener securing the at least one anchor rail.

24. The personal watercraft according to claim 23, wherein the defined recessed channel has a depth such that a head portion of the fastener does not project from an outwardly facing surface of the personal watercraft.

25. The personal watercraft according to claim 18, wherein the personal watercraft includes:

a hull comprising a back surface provided with a pump opening through which a water jet pump is exposed to an environment behind the personal watercraft;

a base deck covering the hull from above and secured to the hull, the base deck comprising a seat support and a rear deck surface located rearward of the seat, the rear deck surface facing upward; and an additional deck comprising the cargo-carrying surface and secured to the base deck to cover the rear deck surface, wherein the at least one anchor rail is mounted on the additional deck, and wherein the additional deck comprises a projecting portion extending rearward beyond the hull and the base deck.

26. The personal watercraft according to claim 25, wherein the additional deck includes a lower surface and a pair of mounting points projecting downward from the lower surface of a lower panel, and the mounting points are located to left and right of the personal watercraft, respectively, of a pump opening and are in contact with the back surface of the hull.

27. The personal watercraft according to claim 25, wherein the personal watercraft comprises: a pair of foot rest surfaces located to left and right of the personal watercraft, respectively, of the seat support and extending in a front-rear direction; and wherein the at least one anchor rail includes a pair of anchor rails arranged in various locations in at least a front-rear direction and spaced apart from each other in a left-right direction.

28. The personal watercraft according to claim 25, further comprising an upper fastener, wherein the additional deck comprises a receiving groove in which the at least one anchor rail is placed from above, a lower surface of a bottom wall of the receiving groove is in contact with the rear deck surface of the base deck, a lower surface of the at least one anchor rail is in contact with an upper surface of the bottom wall of the receiving groove.

29. The personal watercraft according to claim 18 further comprising a first plurality of anchors rails are arranged in a rearwardly raked orientation such that the first plurality of anchor rails extend generally outwardly left of a centerline of the personal watercraft and a second plurality of anchor rails arranged in a rearwardly raked orientation such that the second plurality of anchor rails extend generally outwardly right of the centerline of the personal watercraft.

30. The personal watercraft according to claim 18, wherein the at least one anchor rail is arranged in at least one orientation to encourage a flow of water from the at least one anchor rail.

* * * * *